US007765701B2

(12) United States Patent
Okada

(10) Patent No.: US 7,765,701 B2
(45) Date of Patent: Aug. 3, 2010

(54) SAFETY CUTTER KNIFE

(75) Inventor: Hiroshi Okada, Nara (JP)

(73) Assignee: Olfa Corporation, Osaka (JP)

( * ) Notice: Subject to any disclaimer, the term of this patent is extended or adjusted under 35 U.S.C. 154(b) by 389 days.

(21) Appl. No.: 11/758,617

(22) Filed: Jun. 5, 2007

(65) Prior Publication Data

US 2007/0277382 A1 Dec. 6, 2007

(30) Foreign Application Priority Data

Jun. 6, 2006 (JP) ..... 2006-157651

(51) Int. Cl.
*B26B 3/06* (2006.01)

(52) U.S. Cl. ..... 30/162

(58) Field of Classification Search ..... 30/162, 30/163, 320, 335; 606/167, 170, 172
See application file for complete search history.

(56) References Cited

U.S. PATENT DOCUMENTS 3,176,395 A * 4/1965 Warner et al. ..... 30/162
3,999,290 A * 12/1976 Wood ..... 30/162
4,139,939 A * 2/1979 Crooks ..... 30/162
4,835,865 A * 6/1989 Knoop ..... 30/162
5,617,635 A * 4/1997 Berns ..... 30/162
5,813,121 A * 9/1998 Gringer ..... 30/162
6,044,562 A 4/2000 Dillenbeck
6,058,607 A * 5/2000 Gringer ..... 30/162
6,148,520 A 11/2000 Berns
6,161,290 A * 12/2000 Takamasa ..... 30/162
6,263,577 B1 * 7/2001 Wonderley ..... 30/162
6,418,624 B1 * 7/2002 Huang ..... 30/162
6,550,144 B1 * 4/2003 Berns ..... 30/162
6,553,673 B2 4/2003 Peyrot et al.
6,775,911 B2 8/2004 Tremblay
6,785,966 B2 9/2004 Berns
6,949,109 B2 * 9/2005 Iske et al. ..... 30/162
7,316,070 B2 * 1/2008 Green ..... 30/162
7,540,092 B2 * 6/2009 Polei ..... 30/162
7,596,868 B2 * 10/2009 Berns ..... 30/162
7,596,869 B2 * 10/2009 Berns ..... 30/162
2002/0029482 A1 3/2002 Peyrot et al.
2003/0019109 A1 1/2003 Tremblay
2003/0159290 A1 * 8/2003 Berns ..... 30/162
2005/0193568 A1 * 9/2005 Peyrot et al. ..... 30/162

(Continued)

FOREIGN PATENT DOCUMENTS

DE 3744456 A1 * 7/1988

(Continued)

*Primary Examiner*—Jason Daniel Prone
(74) *Attorney, Agent, or Firm*—Crowell & Moring LLP

(57) ABSTRACT

In the safety cutter knife provided, a blade slide holding a blade is rotated in the direction nearly perpendicular to the longitudinal center line of the housing of the cutter knife by virtue of a reaction force from a work material when the cutting edge of the blade extended from the housing is pressed into the work material while the blade slide and the actuator slide are located at the extended position. With this rotation of the blade slide, the engagement between the blade slide and the actuator slide is released, such that the blade slide with the blade can return automatically from the extended position to the retracted position by virtue of the energizing force of a spring when the blade is released from the work material.

2 Claims, 19 Drawing Sheets

U.S. PATENT DOCUMENTS

| | | | | |
|---|---|---|---|---|
| 2007/0078472 | A1* | 4/2007 | Singh | 606/167 |
| 2007/0283570 | A1* | 12/2007 | Huang | 30/162 |
| 2009/0106983 | A1* | 4/2009 | Berns | 30/162 |
| 2009/0235533 | A1* | 9/2009 | Huang | 30/162 |
| 2009/0260235 | A1* | 10/2009 | Rohrbach | 30/162 |
| 2009/0277016 | A1* | 11/2009 | Wu | 30/162 |

FOREIGN PATENT DOCUMENTS

| | | | |
|---|---|---|---|
| DE | 43 15 495 | A1 | 11/1994 |
| EP | 1864766 | A1 * | 12/2007 |
| JP | 11-4979 | | 1/1999 |
| JP | 2007325663 | A * | 12/2007 |

* cited by examiner

SAFETY CUTTER KNIFE

BACKGROUND OF THE INVENTION

1. Field of the Invention

The present invention relates generally to a cutter knife suited for cutting a relatively soft work material, e.g. cardboard. In particular, the present invention relates to a safety cutter knife, in which the blade returns automatically into the housing at the moment when the cutting operation is completed.

2. Description of the Related Art

Japanese Patent No. 3,409,177 (corresponding to U.S. Pat. No. 6,148,520) discloses this type of a cutter knife.

The safety cutter knife disclosed in Japanese Patent No. 3,409,177 is highly safe in use. In normal use, the cutter knife is slightly inclined with respect to the surface of a sheet, the blade extended from the housing is thrust into the sheet, and the cutter knife is pulled rearward to cut the sheet. At this time, the blade is further extended by the cutting friction resistance of the sheet, whereby a locking mechanism inside the housing is released. After the cutting operation is completed, that is, when the blade is released from the cutting friction resistance, the blade returns automatically by virtue of the energizing force of a spring.

However, in this kind of automatic return mechanism, depending on use conditions, the blade sometimes does not return automatically at the time when the cutting operation is completed. For example, in the case the cutting edge of the blade extended from the housing is placed on a fringe of a sheet of cardboard at right angles, and the cutter knife is drawn downward along the surface of the cardboard to cut the same with the attitude of the cutter knife being kept, the extended blade sometimes does not return automatically when the cutting operation is completed. This is because, in such the manner of cutting operation, a force for further extend the blade is not generated, and thus the automatic return mechanism does not operate.

The various manner of cutting operations will be conducted by the user, as the situations demand. A safer cutter knife applicable various cutting manner is expected to be developed. The technical problem in the prior art automatic return mechanism lies in that the automatic return mechanism is operative, only when the blade is further extended by the friction resistance of the work material.

SUMMERY OF THE INVENTION

Accordingly, the object of the present invention is to provide an improved cutter knife, with which the blade can automatically return into the housing of the cutter knife at the final stage of the cutting operation, even if the blade is not further extended at the final stage of the cutting operation.

In order to achieve the objects of the present invention, there is provided a safety cutter knife comprising:

a housing;

a blade slide accommodated inside the housing so as to be movable in longitudinal direction of the housing between a retracted position and an extended position, the blade slide holding a blade at a front end thereof;

an actuator slide accommodated inside the housing so as to be movable in longitudinal direction of the housing between a retracted position and an extended position, and movable from the retracted position to the extended position when the actuator slide is accessed by the user from the outside of the housing and pushed by thumb operation;

a first spring that always energizes the blade slide toward the retracted position; and a second spring that always energizes the actuator slide toward the retracted position;

wherein the blade slide is provided with a first engage portion that cooperates with the actuator slide, wherein the actuator slide is provided with a second engage portion that engages the first engage portion of the blade slide from behind to extend the blade slide from the retracted position to the extended position when the actuator slide is pushed from the retracted position to the extended position by the user's thumb, and wherein the cutter knife is further provided with a blade rotation mechanism, with which when a cutting edge of the blade extending from the housing is pressed into a work material while the blade slide and the actuator slide are located at the extended position, the blade rotates together with the blade slide in nearly perpendicular direction to the longitudinal direction of the housing by virtue of reaction force from the work material, thereby releasing the engagement between the first engage portion and the second engage portion, such that when the blade is released from the work material, the blade slide returns automatically from the extended position to the retracted position by virtue of energizing force of the first spring.

With the cutter knife of the present invention constructed as above, the blade slide holding the blade is rotated by the reaction force from the work material during the cutting operation, and thereby releasing the engagement between the first engage portion and second engage portion, which had kept the blade slide together with the blade at the extended position. At this situation, the blade slide is ready to return automatically to the retracted position, even if the actuator slide is kept at the extended position with the user's thumb. However, the blade slide does not return automatically because the blade cutting into the work material is held by the friction force of the work material.

After the cutting operation is completed, at the moment when the blade is released from the work material, the blade slide returns automatically into the housing of the cutter knife by virtue of the energizing force of the first spring. Hence, even if the user touches the cutter knife owing to the momentum of the cutting operation after the cutting, the user is free from the danger of being injured by the blade. According to the present invention, the engagement between the first engage portion and second engage portion is released by the rotation of the blade slide. Therefore, the nipping force (friction resistance) from the work material for further extending out the blade at the final stage of the cutting operation is not required, which was required in the abovementioned conventional cutter knife. When a work material is cut with a cutter knife, the reaction force from the work material is necessarily applied to the blade without exception. Hence, the engagement between the first engage portion and second engage portion can be certainly released, regardless of the use manner of the cutter knife. As a result, after the cutting operation is completed, the blade slide can be certainly returned to its initial retracted position, and the safety is enhanced.

BRIEF DESCRIPTION OF THE DRAWINGS

These and other objects and features of the present invention will become apparent from the following description taken in conjunction with the preferred embodiments thereof with reference to the accompanying drawings.

FIG. 1-1 is an operation explanatory view showing the initial state of the cutter knife shown in FIG. 1, the blade slide and the actuator slide being located at the retracted position.

FIG. 1-2 is an operation explanatory view similar to FIG. 1-1, the two slides being located at the extended position.

FIG. 1-3 is an operation explanatory view similar to FIG. 1-1, the two slides being located at the extended position, the blade being pressed against the work material, and the blade slide being rotated-up.

FIG. 1-4 is an operation explanatory view similar to FIG. 1-1, showing the initial cutting stage wherein the blade is pressed into the work material.

FIG. 1-5 is an operation explanatory view similar to FIG. 1-1, the cutting operation being completed, and the blade slide having returned automatically to the initial position, that is, the retracted position.

FIG. 1-6 is an operation explanatory view similar to FIG. 1-1, the two slides having returned to the retracted position.

FIG. 1-7 is a rear perspective view of the blade slide, which is a component of the cutter knife shown in FIG. 1.

FIG. 2 is an exploded perspective view of a safety cutter knife according to the second embodiment of the present invention.

FIG. 2-1 is an operation explanatory view showing the initial state of the cutter knife shown in FIG. 2, the blade slide and the actuator slide being located at the retracted position.

FIG. 2-2 is an operation explanatory view similar to FIG. 2-1, the two slides being located at the extended position.

FIG. 2-3 is an operation explanatory view similar to FIG. 2-1, the two slides being located at the extended position, the blade being pressed against the work material, and the blade slide being rotated-up.

FIG. 2-4 is an operation explanatory view similar to FIG. 2-1, showing the initial cutting stage wherein the blade is pressed into the work material.

FIG. 2-5 is an operation explanatory view similar to FIG. 2-1, the cutting operation being completed, and the blade slide having returned automatically to the initial position, that is, the retracted position.

FIG. 2-6 is an operation explanatory view similar to FIG. 2-1, the two slides having returned to the retracted position.

FIG. 2-7 is a rear perspective view of the blade slide, which is a component of the cutter knife shown in FIG. 2.

FIG. 2-8 shows the temporary retaining mechanism according to a modification of the cutter knife shown in FIG. 2.

FIG. 3 is an exploded perspective view of a safety cutter knife according to another modification of the first and second embodiments.

FIG. 3-1 is an operation explanatory view showing the initial state of the cutter knife shown in FIG. 3, the blade slide and the actuator slide being located at the retracted position.

FIG. 3-2 is an operation explanatory view similar to FIG. 3-1, the two slides being located at the extended position.

FIG. 3-3 is an operation explanatory view similar to FIG. 3-1, the two slides being located at the extended position, the blade being pressed against the work material, and the blade slide being rotated-up.

FIG. 3-4 is an operation explanatory view similar to FIG. 3-1, showing the initial cutting stage wherein the blade is pressed into the work material.

FIG. 3-5 is an operation explanatory view similar to FIG. 3-1, the cutting operation being completed, and the blade slide having returned automatically to the initial position, that is, the retracted position.

FIG. 3-6 is an operation explanatory view similar to FIG. 3-1, the blade slide having returned automatically to the retracted position, but the actuator slide being located just before of the retracted position.

FIG. 4 is an exploded perspective view of a safety cutter knife according to the third embodiment of the present invention.

FIG. 4-1 is an operation explanatory view showing the initial state of the cutter knife shown in FIG. 4, the blade slide and the actuator slide being located at the retracted position. An overall vertical sectional view (I) and a main sectional view (II) are included.

FIG. 4-2 is an operation explanatory view similar to FIG. 4-1, the two slides being located at the extended position.

FIG. 4-3 is an operation explanatory view similar to FIG. 4-1, the two slides being located at the extended position, the blade being pressed against the work material, and the blade slide being rotated-up.

FIG. 4-4 is an operation explanatory view similar to FIG. 4-1, showing the initial cutting stage wherein the blade is pressed into the work material. The main sectional view (II) is omitted.

FIG. 4-5 is an operation explanatory view similar to FIG. 4-1, the cutting operation being completed, and the blade slide having returned automatically to the initial position, that is, the retracted position. The main sectional view (II) is omitted.

FIG. 4-6 is an operation explanatory view similar to FIG. 4-1, the blade slide having returned automatically to the retracted position, but the actuator slide being located just before of the retracted position. The main sectional view (II) is omitted.

FIG. 4-7 is a rear perspective view of the blade slide, which is a component of the cutter knife shown in FIG. 4.

FIG. 5 is an exploded perspective view of a safety cutter knife according to the fourth embodiment of the present invention.

FIG. 5-1 is an operation explanatory view showing the initial state of the cutter knife shown in FIG. 5, the blade slide and the actuator slide being located at the retracted position. An overall vertical sectional view (I), a transverse sectional view (II), and a main sectional view (III) are included.

FIG. 5-2 is an operation explanatory view similar to FIG. 5-1, the two slides being located at the extended position.

FIG. 5-3 is an operation explanatory view similar to FIG. 5-1, the two slides being located at the extended position, the blade being pressed against the work material, and the blade slide being rotated-up.

FIG. 5-4 is an operation explanatory view similar to FIG. 5-1, showing the initial cutting stage wherein the blade is pressed into the work material.

FIG. 5-5 is an operation explanatory view similar to FIG. 5-1, the cutting operation being completed, and the blade slide having returned automatically to the initial position, that is, the retracted position. The rotated attitude of the blade slide is kept.

FIG. 5-6 is an operation explanatory view similar to FIG. 5-1, the blade slide having returned automatically to the retracted position, and the blade slide having returned to the initial non-rotated attitude.

DETAILED DESCRIPTION OF THE PREFERRED EMBODIMENT

Figure 1:
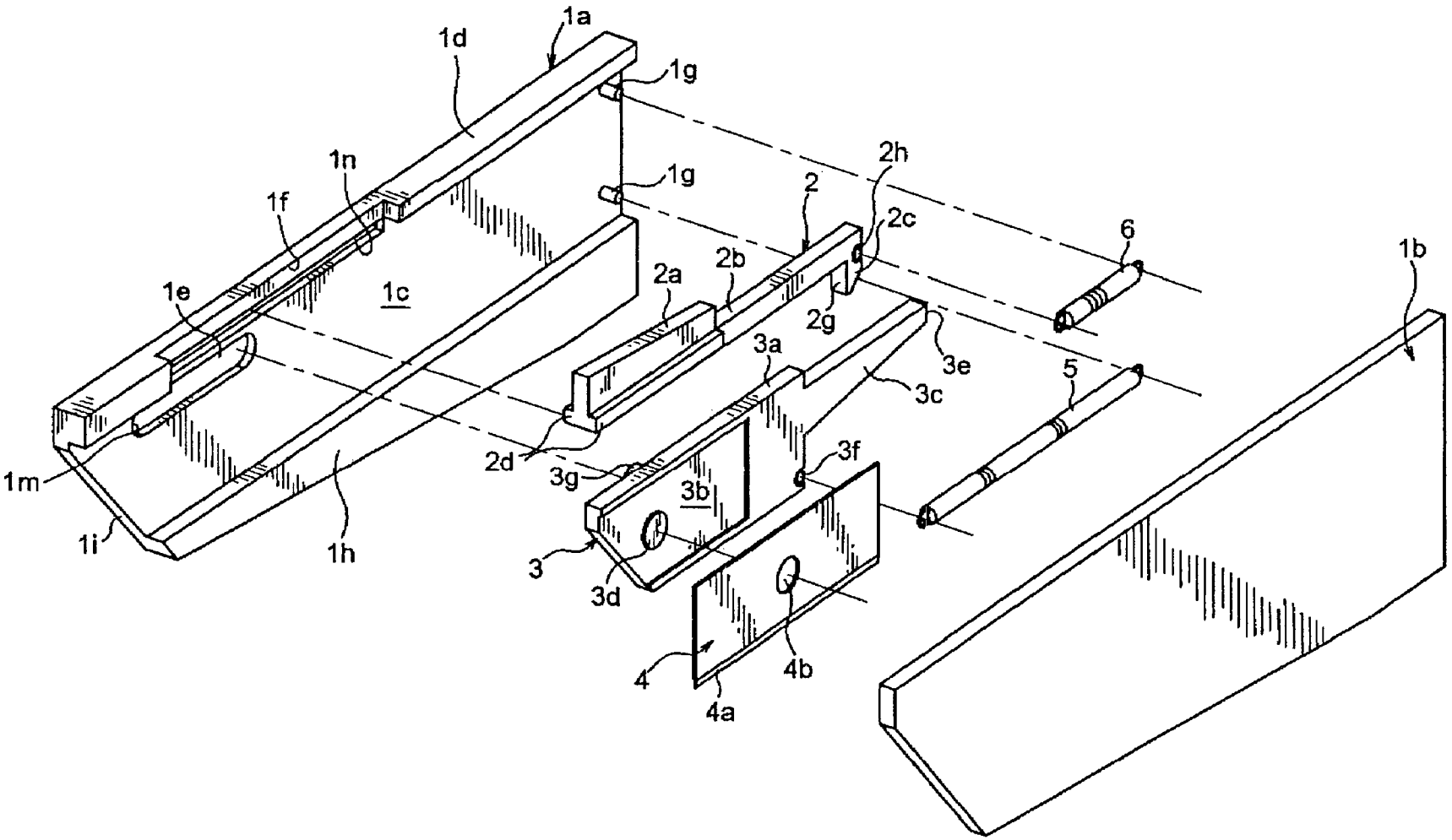
FIG. 1 is an exploded perspective view of a safety cutter knife according to the first embodiment of the present invention.
Figure 1:
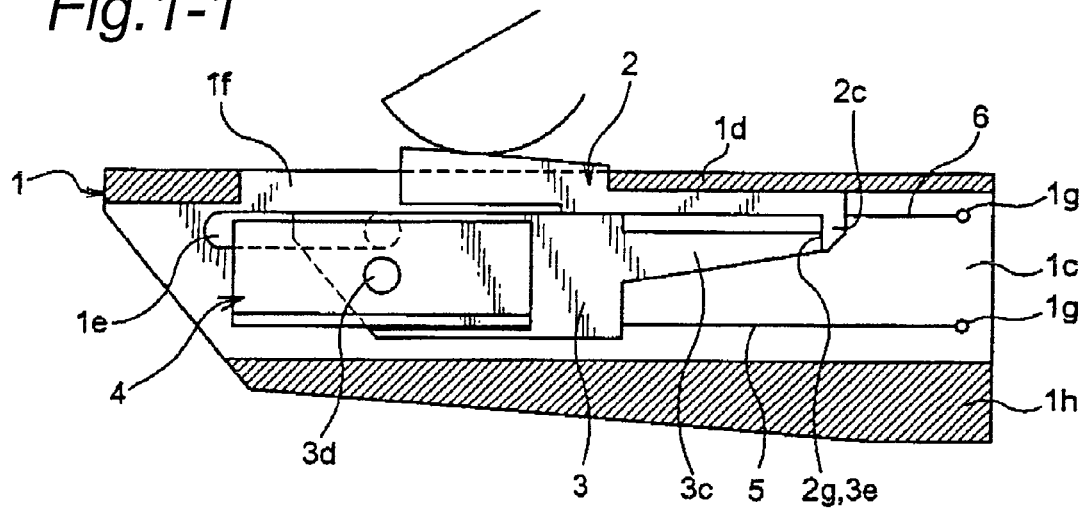

Embodiments according to the present invention will be described below in detail sequentially referring to the accompanying drawings.

First Embodiment

FIGS. 1 and 1-1 to 1-7 show a first embodiment. This embodiment is simplest and most basic. The safety cutter knife basically comprises a housing 1 (1*a*+1*b*), a blade slide 3, an actuator slide 2, a first spring 5, and a second spring 6.

The blade slide 3, which holds a blade 4 at its front end, is accommodated inside the housing 1 so as to be movable in the longitudinal direction between two positions, that is, a retracted position (FIGS. 1-1, 1-5, and 1-6) and an extended position (FIGS. 1-2, 1-3, and 1-4).

The actuator slide 2 is accommodated inside the housing 1 so as to be movable in the longitudinal direction between two positions, that is, a retracted position and an extended position. The actuator slide 2 is movable from the retracted position to the extended position when the actuator slide 2 is accessed by the user from the outside of the housing 1 and pressed by thumb operation.

The first spring 5 always energizes the blade slide 3 in the direction toward the retracted position, and the second spring 6 always energizes the actuator slide 2 in the direction toward the retracted position.

As clearly shown in FIG. 1, the housing 1 comprises a housing body 1*a* and a lid body 1*b* covering the housing body 1*a*. The lid body 1*b* is formed of a simple flat plate. On the other hand, the housing body 1*a* has an accommodation space 1*c* for accommodating various members. This accommodation space 1*c* is formed of an upper wall 1*d*, a lower wall 1*h*, and a flat wall 1*i*. A knob-guide-slot 1*f* is formed in the front portion of the upper wall 1*d*, along which the knob 2*a* of the actuator slide 2 can slide. A slide-guide-slot 1*e* is formed in the front portion of the flat wall 1*i* (toward left in the figure) to guide the movement of the blade slide 3. Both ends of the slide-guide-slot are formed in a semicircular shape. A pair of engage pins 1*g* is provided in the inner rear portion of the flat wall. The engage pins 1*g* hold the rear ends of the first and second springs 5 and 6.

The actuator slide 2 has the knob 2*a* that can be operated by user's thumb from the outside of the housing, and an extension portion 2*b* extending rearward from the knob 2*a*. At the rear end of the extension portion 2*b*, there is formed a second engage portion (a hook 2*c*), which is bent downward in an L-shape. On both sides of the lower portion of the knob 2*a*, guide step portions 2*d* are formed. The knob 2*a* and the guide step portions 2*d* are fitted inside the knob-guide-slot if of the housing body and a guide groove in formed thereunder, and made movable in the longitudinal direction of the housing. The user can access to the knob 2*a* from the outside of the housing and move the actuator slide 2 with his/her thumb. The front face of the hook 2*c* serves as a pushing-engage-face 2*g* that can push the first engage portion (pushed-engage-face 3*e*) of the blade slide 3.

On the other hand, the blade slide 3 has a blade holding portion 3*a* positioned under the knob 2*a* to hold the blade 4, and an extension portion 3*c* positioned under the extension portion 2*b* of the actuator slide 2. The extension portion 3*c* extends rearward from the blade holding portion 3*a* in nearly parallel with the extension portion 2*b* of the actuator slide 2. The rear end face of the extension portion 3*c* serves as the first engage portion (pushed-engage-face) 3*e*, with which the pushing-engage-face 2*g* of the hook of the actuator slide 2 makes contact from behind. A blade accommodating concave portion 3*b* is formed on the front face side of the blade holding portion 3*a*. A blade holding protrusion 3*d* is formed in this blade accommodating concave portion 3*b*. The blade 4 having a nearly rectangular shape is accommodated inside the blade accommodating concave portion 3*b*, and positioned in place by the blade holding protrusion 3*d* fitting in the engage hole 4*b* of the blade 4. On the back face side of the blade holding portion 3*a*, a round pin 3*g* protrudes, which slidably fits in the slide-guide-slot 1*e* formed in the housing body 1*a*. The blade slide 3 can move in the longitudinal direction of the housing within the range of the length of this slot 1*e*.

The first and second springs 5 and 6 are each formed of a coil spring. The rear end of the first spring 5 is hooked to the engage pin 1*g* disposed in the lower portion of the housing body, and the front end thereof is hooked to an engage pin 3*f* disposed slightly behind the blade accommodating concave portion 3*b* of the blade slide. On the other hand, the rear end of the second spring 6 is hooked to the engage pin 1*g* disposed in the upper portion of the housing body, and the front end thereof is hooked to an engage pin 2*h* disposed on the hook 2*c* of the actuator slide 2. Hence, the both of two slides 2 and 3 are always energized by the two springs 6 and 5 so as to be pulled into the housing.

Figures 1, 2:
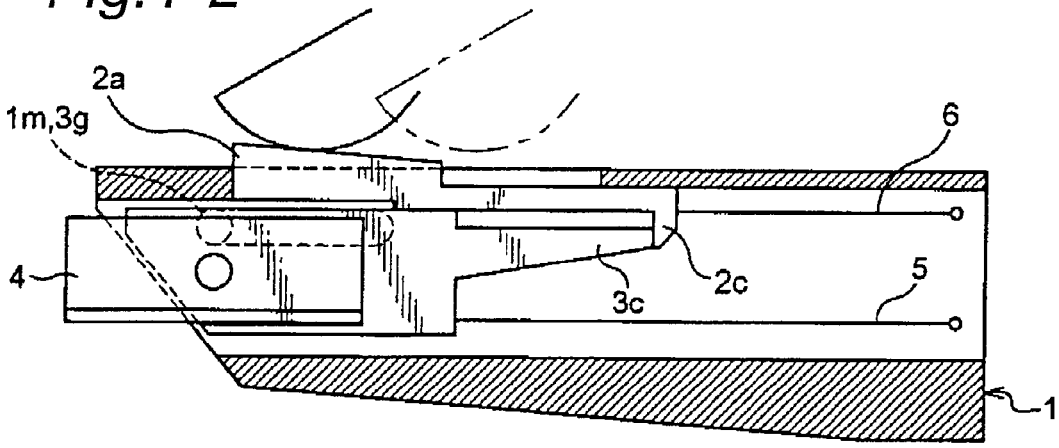

The cutter knife according to the first embodiment is configured as described above. Next, the operation of the cutter knife configured as described above and the further detailed structure thereof will be described referring to FIGS. 1-1 to 1-6. FIG. 1-1 shows the cutter knife in FIG. 1 in its initial state (out of operation). The actuator slide 2 is retracted to the retracted position by the second spring 6, and the blade slide 3 is also retracted to the retracted position by the first spring 5. The knob 2*a* of the actuator slide 2 makes abutting contact with the right end (in the figure) of the knob-guide-slot 1*f*. In addition, the round pin 3*g* of the blade slide 3 makes abutting contact with the right end (in the figure) of the slide-guide-slot 1*e*. In the state shown in FIG. 1-1, when the user operates the knob 2*a* with his/her thumb to push the knob toward the extended position in the longitudinal direction of the housing (leftward direction in the figure), the pushing-engage-face 2*g* of the hook 2*c* pushes the pushed-engage-face 3*e* of the blade slide forward, such that the two slides 2 and 3 reach the extended positions as shown in FIG. 1-2. As a result, the front portion of the blade 4 is exposed outside sufficiently. In this state, the knob 2*a* makes contact with the end face of the knob-guide-slot if, and the round pin 3*g* makes contact with the semicircular end face 1*m* (a fulcrum) of the slide-guide-slot 1*e*. The cutting edge 4*a* of the rectangular blade 4 is formed at the lower side thereof as shown in the figure.

Figures 1, 2, 3:
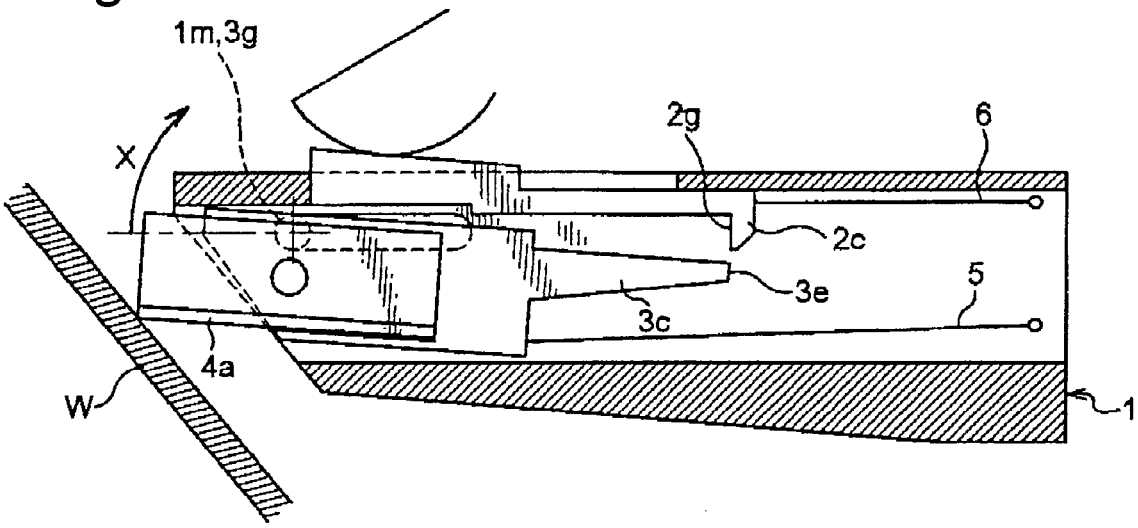

When a work material W is cut, the cutting edge 4*a* of the blade is pressed against the work material W as shown in FIG. 1-3, and further pressed down at a stretch as shown in FIG. 1-4. The blade 4 is thus rotated slightly upward in the direction X as shown in the figure together with the blade slide 3 around the round pin 3*g* that makes contact with the semicircular end face 1*m* by the reaction force exerted from the work material W against the energizing force of the first spring 5. By this rotation, the pushed-engage-face 3*e* of the blade slide 3 is disengaged from the hook 2*c* as shown in FIGS. 1-3 and 1-4. In other words, the engagement between the first and second engage portions 3*e* and 2*c* is released, and now the blade slide 3 is in a state of being capable of returning to the retracted position by virtue of the tension force of the first spring 5. However, the blade 4 has cut into the work material W, and the cutter knife is pulled along the work material W in the direction Y. Hence, the automatic return of the blade 4 is prevented, because of the friction force generated by the work material W to the blade 4.

When the cutting is completed (FIG. 1-5), the blade 4 is released from the work material W. At the moment when the blade 4 is released, the blade slide 3 holding the blade 4 returns automatically to the retracted position, that is, the initial position. This automatic return occurs even if the thumb of the user makes contact with the knob 2*a* as shown in FIG. 1-5 (regardless of the position of the knob 2*a*). Since the blade is retracted into the housing at the moment when the cutting is completed, danger of cutting user itself with the blade owing to the momentum of the cutting operation can be certainty prevented. Next, when the user releases his/her thumb from the knob 2*a* as shown in FIG. 1-6, the actuator slide 2 returns automatically to the original position, that is, the retracted position, by virtue of the tension force of the second spring 6. At this, the hook 2*c* slides on the upper face of the extension portion 3*c* of the blade slide 3. Since the first spring 5 energizes the blade slide 3 to rotate counterclockwise around the round pin 3*g* in the direction V in the figure, the blade slide 3 is rotated eventually counterclockwise in the direction V. Then, the pushed-engage-face (the first engage portion) 3*e* engages the pushing-engage-face 2*g* of the hook (the second engage portion).

Second Embodiment

In the first embodiment described above, a pin rotation mechanism is used as a rotation mechanism for the blade slide 3. As another preferable form of the rotation mechanism, a seesaw rotation mechanism shown in FIGS. 2 and 2-1 to 2-8 is provided in a second embodiment. The second embodiment is similar to the first embodiment in basic structure. Differences from the first embodiment will mainly be described below.

The actuator slide 2 has a straight bottom face 2*f* extending in the longitudinal direction of the housing 1. On the other hand, the blade slide 3 has a crown upper face 3*i* that comprises a front inclined face 3*t* extending forward and a rear inclined face 3*u* extending rearward, with a center apex 3*j* being the boundary therebetween. The crown upper face 3*i* makes slide contact with the straight bottom face 2*f* of the actuator slide. Although the blade slide 3 according to the second embodiment also has a round pin 3*g*' on the back face thereof, this round pin 3*g*' is slightly different from the round pin 3*g* in to the first embodiment. In other words, a guide slot 1*e*' formed in the housing, in which the round pin 3*g*' is to be engaged, is made considerably larger than the diameter of the round pin 3*g*' so that the round pin 3*g*' is movable up and down in the guide slot 1*e*'. The combination <<the round pin 3*g*' and the guide slot 1*e*'>> in the second embodiment and the combination <<the round pin 3*g* and the guide slot 1*e*>> in the first embodiment have a common function to define the retracted position and the extended position of the blade slide 3. In other words, when the blade slide 3 is located at the retracted position, the round pin 3*g*' makes contact with the end of the guide slot 1*e*' on the side of the retracted position. On the other hand, when the blade slide 3 is located at the extended position, the round pin 3*g*' makes contact with the end of the guide slot 1*e*' on the side of the extended position (FIGS. 2-1 and 2-2).

One characteristic of the cutter knife according to the second embodiment is to have a temporary retaining mechanism, which temporarily retains the rotated attitude of the blade slide 3 during cutting operation. That is, the temporary retaining mechanism temporarily keeps the blade slide 3 in rotated under the reaction force exerted from the work material W, at the extended position during the work material is cut. When the blade 4 is released from the work material W and the blade slide 3 returns automatically from the extended position to the retracted position by virtue of the energizing force of the first spring 5, the temporary retain will be released by virtue of the energizing force of the first spring 5. More specifically, the blade slide 3 has an engage protrusion 3*h* protruding upward on the upper face of the front portion thereof. On the other hand, the actuator slide 2 has an engage notch 2*e* on the bottom face of the front portion thereof, which receives the engage protrusion 3*h* when the blade slide 3 is rotated at the cutting operation. The width of this notch 2*e* is made slightly larger than that of the engage protrusion 3*h*.

Figures 1, 2, 3, 4:
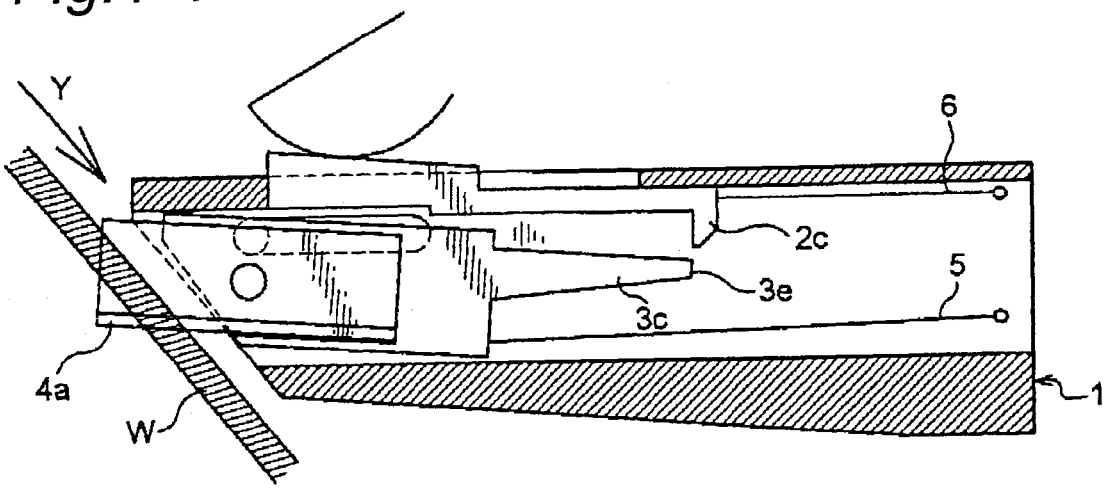

The effects obtained in the second embodiment will be described below referring to FIGS. 2-1 to 2-6. In the retracted state shown in FIG. 2-1, whole of the blade slide 3 is energized so as to rotate counterclockwise in the figure by the energizing force of the first spring 5. Hence, the blade slide 3 is inclined so that the rear inclined face 3*u* of the blade slide 3 makes contact with the straight bottom face 2*f* of the actuator slide 2. While this attitude is kept, the blade slide 3 is moved from the retracted position to the extended position together with the actuator slide 2 by knob operation (the movement from the position in FIG. 2-1 to the position in FIG. 2-2). When the cutting edge of the blade 4 is pressed against the work material W as shown in FIG. 2-3 and the cutting edge cuts into the work material W as shown in FIG. 2-4, the blade slide is rotated around the center apex 3*j* on the crown upper face by the reaction force exerted from the work material W against the energizing force of the first spring 5, and whereby the front inclined face 3*t* makes contact with the bottom face 2*f* of the actuator slide 2. As a result, the engagement between the first and second engage portions 3*e* and 2*c* is released, and the engage protrusion 3*h* is fitted into the engage notch 2*e* (FIG. 2-3). Since the engage notch 2*e* is made slightly larger than the engage protrusion 3*h* in the right direction in the figure, simultaneously when the engagement between the first and second engage portions 3*e* and 2*c* is released, the blade slide 3 moves slightly in the right direction in the figure by virtue of the energizing force of the first spring 5. As a result, the first engage portion 3*e* is located under the second engage portion 2*c* (FIG. 2-4).

With this configuration, as long as the reaction force is applied from the work material to the blade even if the force is slight, the temporary retaining mechanism operates to prevent the blade slide 3 from automatically returning inadvertently during the cutting operation. If the blade returns automatically because of the energizing force of the first spring despite the user's intention when the force exerted from the work material to nip the blade becomes weak during cutting operation for some reason, this results in undesirable interruption of the cutting operation. This kind of trouble can be prevented by providing the temporary retaining mechanism. In the case for example that the cutter knife with no temporary retaining mechanism (like in the first embodiment) is used to cut a few sheets of paper placed on a hard base (although such is not a manner originally intended for this cutter knife), if the force for pressing the blade against the hard base becomes weak even slightly, the blade slide 3 will automatically return immediately to the retracted position under the energizing force of the first spring 5, because the blade 4 does not cut into the hard base, or because the paper does not have a force to nip the blade. This may be inconvenient. On the other hand, in the second embodiment, the engage protrusion 3*h* slightly engages the engage notch 2*e*, thereby preventing the blade slide 3 from returning automatically inadvertently. As shown in FIG. 2-5, when the cutting of the work material W is completed and the blade is released from the work material W, the blade slide 3 is rotated like in the first embodiment around the center apex 3*j* by the energizing force of the first spring 5 opposite to the direction X, and the temporary retaining mechanism is released. After the temporary retaining mechanism is released, the blade slide 3 moves along the lower area in the accommodation space 1*c* and returns to the retracted position. As shown in FIG. 2-6, when the user releases his/her thumb from the knob 2*a*, the actuator slide 2 returns to the retracted position. At this position, the blade slide 3 rotates, so that the rear inclined face 3*u* makes contact with the straight bottom face 2*f* of the actuator slide 2, thereby the engagement between the first and second engage portions 3*e* and 2*c* is again realized.

Modification 1 of the Second Embodiment

In the embodiment described above, the engage protrusion 3*h* is formed on the blade slide 3 and the engage notch 2*e* is formed on the actuator slide 2. However, the protrusion and the notch may be formed on either one of the two members. Furthermore, one of the protrusion and the notch may be formed on the inner face of the housing. FIG. 2-8 shows one modification. In this modification, an engage protrusion 3*h*' is formed on the inner face of the upper wall 1*d* of the housing 1, and an engage notch 2*e*' is formed on the blade slide 3. The concave-convex relationship is just opposite to that in the second embodiment. The action of the temporary retaining mechanism is substantially the same to that of the second embodiment.

Modification 2 of the First and Second Embodiments

In the first and second embodiments described above, in some of actual design of the cutter knife, before the blade slide 3 returns automatically, the first engage portion 3*e* may inconveniently reengage the second engage portion 2*c*. For certainly avoiding such the early reengagement, it is preferable to form a spring engage piece 3*m* at the rear end of the blade extension portion 3*c*, which serves as the first engage portion 3*e* of the blade slide 3, as in the modification in FIGS. 3 and 3-1 to 3-6. In order to ensure that the spring engage piece 3*m* can deflect in the back-and-forth direction, a cutout groove 3*k* is formed adjacent to the spring engage piece 3*m*. The spring engage piece 3*m* is configured so that the upper free end thereof can be inclined elastically in the back-and-forth direction of the housing with respect to the lower base portion thereof serving as the stationary end. The pushed-engage-face 3*e* is formed of a pushed-inclined-face 'ea' that is inclined slightly upward and rearward. On the other hand, the pushing-engage-face 2*g*' of the hook 2*c* is formed of a pushing-inclined-face 'ga' that is inclined slightly downward and forward, corresponding to the pushed-inclined-face 'ea'. The lower portion of the outer face of the hook 2*c* is formed of an inclined face 2*i* that is inclined slightly downward and forward. Furthermore, an inclined face 3*v* being inclined slightly downward and forward is formed at the rear end of the extension portion of the blade slide 3.

Figures 1, 2, 3, 4, 5:
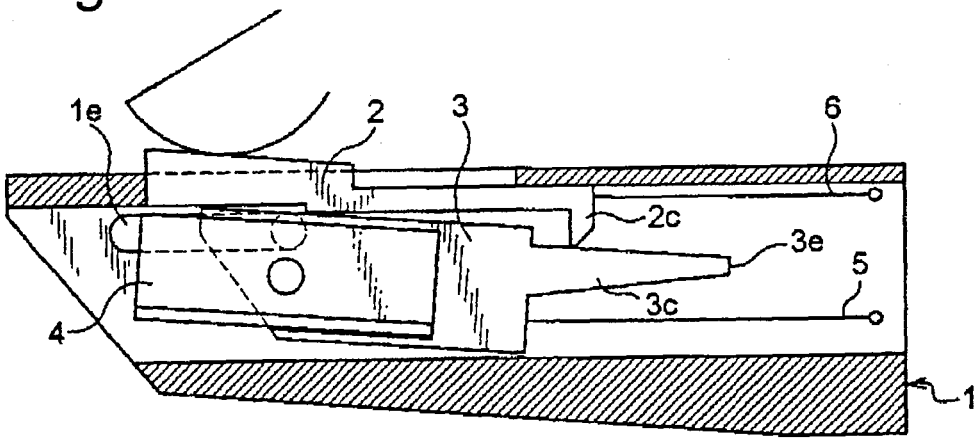

With the configuration described above, when the actuator slide 2 is pushed out from the retracted position to the extended position, the spring engage piece 3*m* is pressed with the hook 2*c* and deflected slightly forward elastically, as shown in FIG. 3-2. When the blade slide 3 is rotated and the spring engage piece 3*m* is disengaged from the hook 2*c* in the cutting operation to the work material W, the spring engage piece 3*m* returns rearward elastically and is located under the hook 2*c*, as shown in FIG. 3-3. Hence, when the blade slide 3 is rotated opposite to the direction X at the completion of cutting operation, the spring engage piece 3*m* does not reengage the hook 2*c*, and the blade slide 3 quickly returns to the retracted position by virtue of the energizing force of the first spring 5 (FIG. 3-5). When the actuator slide 2 is released at the final stage, the actuator slide 2 quickly returns to the retracted position by virtue of the energizing force of the second spring 6. At this time, the inclined face 2*i* of the hook 2*c* pushes down the inclined face 3*v* of the blade slide 3. With the round pin 3*g* being in contact with the retraction end of the guide slot 1*e*, the blade slide 3 is rotated and thus whole of the blade slide 3 is rotated in the direction X (FIG. 3-6). As a result, the hook 2*c* passes the inclined face 3*v* and the spring engage piece 3*m*, thereby returning to the initial state shown in FIG. 3-1.

Third Embodiment

FIGS. 4 and 4-1 to 4-7 show a safety cutter knife according to a third embodiment of the present invention. FIG. 4 is an exploded perspective view, and FIGS. 4-1 to 4-6 are explanatory views showing the operation of the safety cutter knife. The basic structure of the cutter knife according to the third embodiment is substantially the same as that of the first embodiment. In the modification shown in FIGS. 3 and 3-1 to 3-6, when the blade slide returns to the retracted position after rotated at the extended position, the first engage portion 3*e* of the blade slide 3 is prevented from reengaging the second engage portion 2*c* of the actuator slide 2 at the initial stage of the return, as described above. The third embodiment provides a configuration for preventing such the early reengagement with more certainty.

The configuration of the third embodiment will be described below referring mainly to FIGS. 4 and 4-7. Substantially the same components and configurations as those of the first embodiment are not described. The additional characteristic of the cutter knife according to the third embodiment lies in a rotational-position-retaining-mechanism, which keeps the rotational position of the blade slide 3, from the time the blade slide 3 is rotated up as described above at the extended position in the cutting operation, to the time the blade slide 3 returns to just before the retracted position after the cutting operation is completed, and which releases the blade slide 3 when the same reaches the retracted position. This rotational-position-retaining-mechanism comprises a rib 1*k* and a click spring piece 3*n*. The rib 1*k* is formed on the inner face of the flat wall 1*i* (opposed to the blade slide 3) of the housing 1, so as to extend in the longitudinal direction of the housing 1. The click spring piece 3*n* formed on the face (opposed to the inner face 1*i*) of the blade slide 3, so as to cooperate with the rib 1*k*. The rib 1*k* is formed inside a concave portion 1*j* formed at a predetermined area of the flat wall 1*i* of the housing 1. The rib 1*k* has an inclined face is as shown in FIG. 4 and other figures.

On the other hand, the click spring piece 3*n* is formed in a part of the blade holding portion 3*a* of the blade slide 3 (FIG. 4-7). The lower base portion of the click spring piece 3*n* is configured so as to serve as a stationary end. The upper portion thereof is a free end, providing the flexibility so as to deflect elastically in the direction perpendicular to the face of the blade slide 3. A click protrusion 3*s* cooperating with the rib 1*k* is provided on the back face of the free end.

Next, the operation and other configurations will be described below referring to FIGS. 4-1 to 4-6. When the blade slide 3 is located at the retracted position as shown in FIG. 4-1, the click spring piece 3*n* is released from the rib 1*k*. In other words, the end of the rib 1*k* on the side of the retracted position does not reach the click spring piece 3*n*. When the blade slide 3 moves from the retracted position to the extended position in FIG. 4-2, the click protrusion 3*s* of the click spring piece 3*n* moves along the upper side of the rib 1*k*, that is, moves along the inclined face is of the rib 1*k*. In the state shown in FIG. 4-3, when the cutting edge of the blade 4 is pressed against the work material W and further pressed as shown in FIG. 4-4, the blade slide 3 is rotated in the direction indicated by the arrow X. At this time, the click protrusion 3*s* of the click spring piece 3*n* climbs over the ribs 1*k* elastically and moves from upward to downward in the direction Z shown in the figure. At this time, the user feels the clicking. This rotated attitude of the blade slide 3 is kept by the round pin 3*g* fitting in the slide-guide-slot 1*e* and by the click protrusion 3*s* engaging the downward side of the rib 1*k*. In this state, of course, the first and second engage portions 3*e* and 2*c* do not engage each other, as shown in FIGS. 4-3 and 4-4. After the cutting operation is completed, the blade slide 3 automatically returns immediately by virtue of the energizing force of the first spring 5. At this time, the click protrusion 3*s* moves along under side of the rib 1*k*. Hence, the blade slide 3 returns while its rotated attitude is kept. When the blade slide 3 returns to the retracted position, that is, the final position, the click protrusion 3*s* is released from the rib 1*k*, and thus the blade slide 3 returns to the initial position shown in FIG. 4-1 (see FIG. 4-5). Next, when the user releases the actuator slide 2, the actuator slide 2 also returns to the initial position shown in FIG. 4-1.

Fourth Embodiment

The third embodiment described above provides the mechanism, by which the rotated attitude of the blade slide 3 at the extended position is kept using the rib 1*k* formed on the housing 1 and the click spring piece 3*n* formed on the blade slide 3. A fourth embodiment, which is a further improvement over the third embodiment, will be described below referring to FIGS. 5 and 5-1 to 5-6.

The basic structure of the cutter knife according to the fourth embodiment is also substantially the same as those in the first embodiment and the third embodiment. The safety cutter knife according to the fourth embodiment is applicable to both of right- and left-handed users, with selecting the upper/lower position of the cutting edge of the blade 4 when it is mounted to the blade slide 3. The rotation mechanism in the forth embodiment is configured so that the blade slide 3 is made rotatable in both the upward and downward directions at the extended position.

Figures 1, 2, 3, 4, 5, 6:
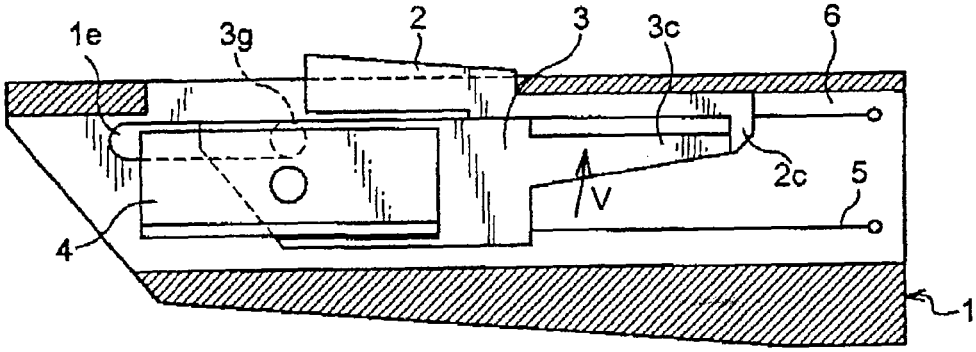
Figures 1, 2, 3, 4, 5, 6, 7:
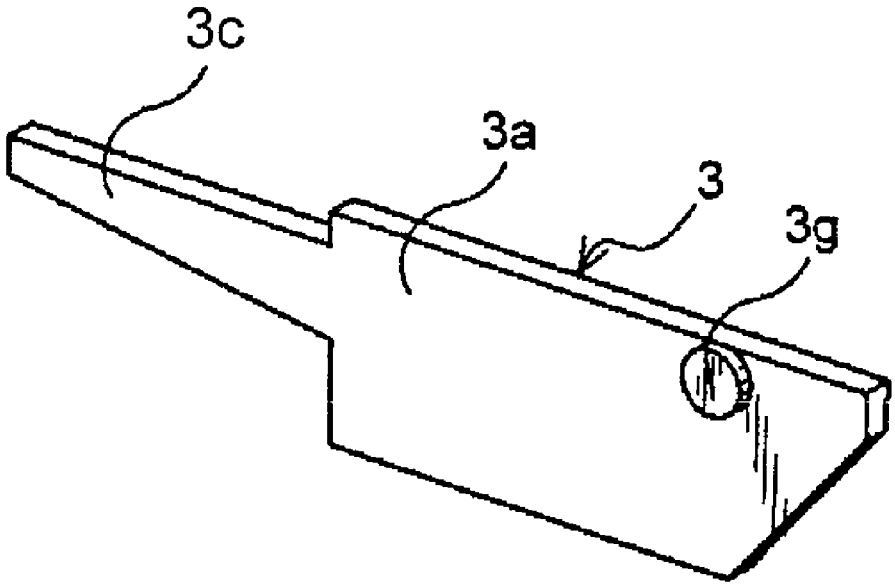
Figure 2:
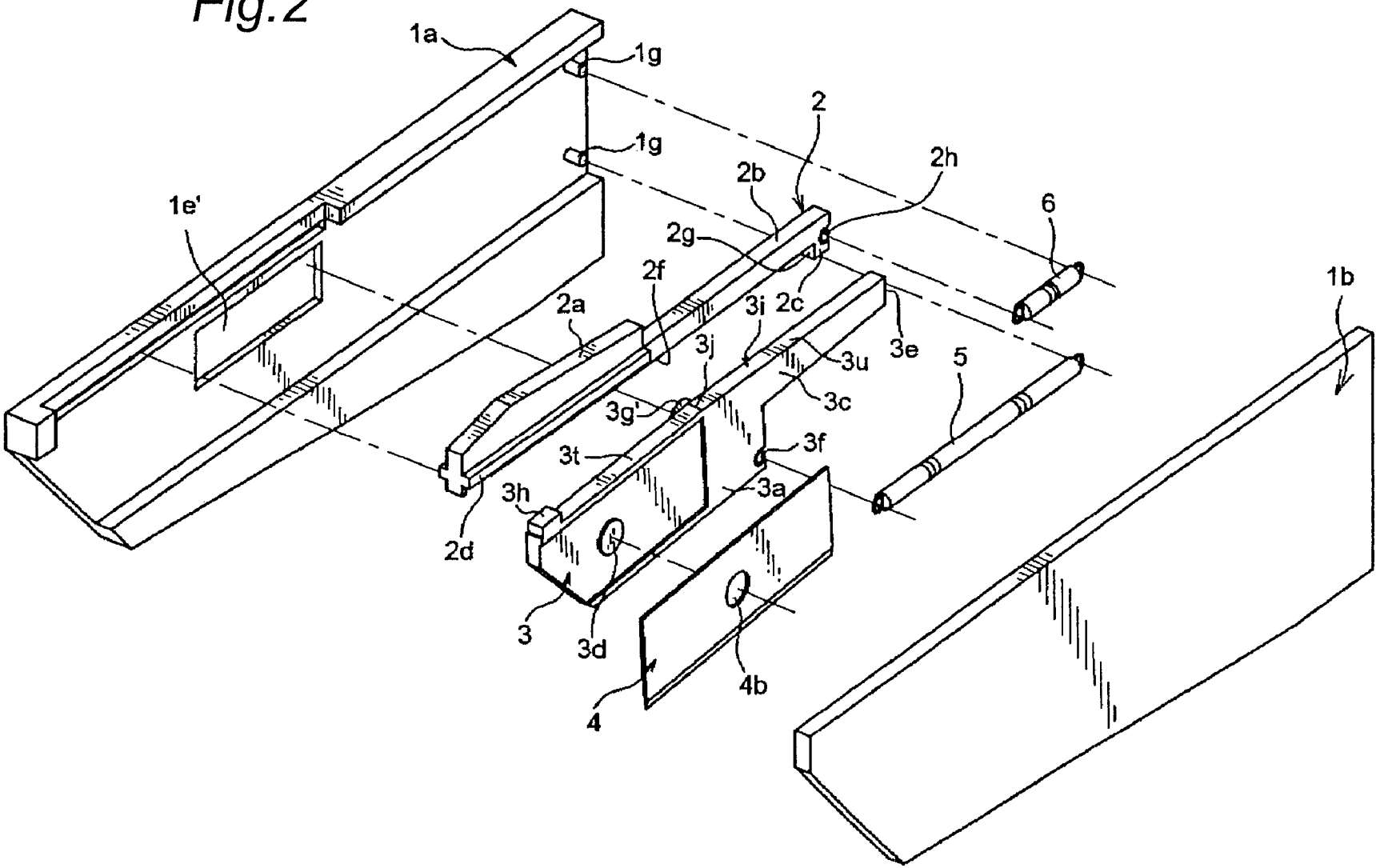
Figures 1, 2:
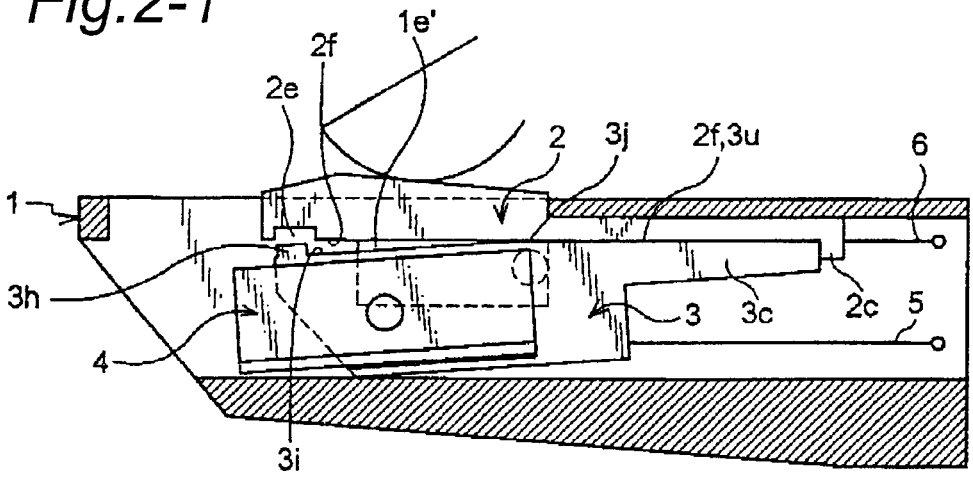
Figure 2:
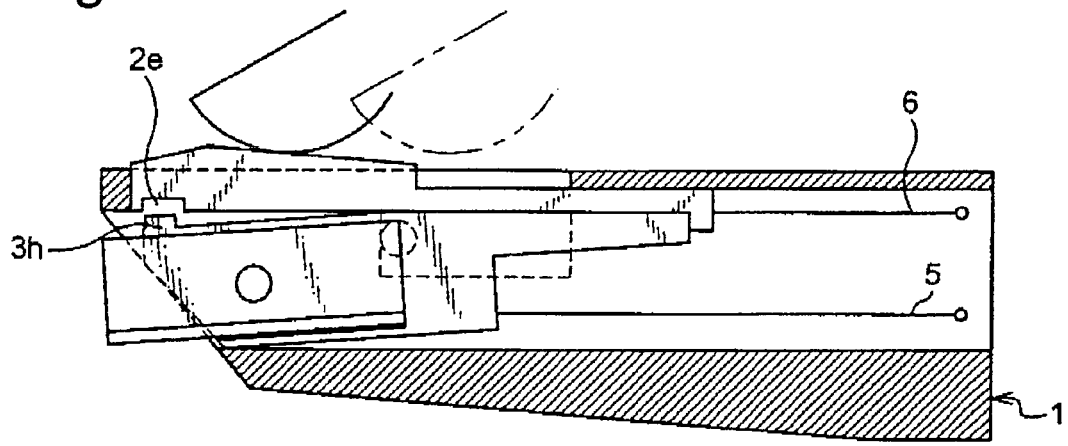
Figures 2, 3:
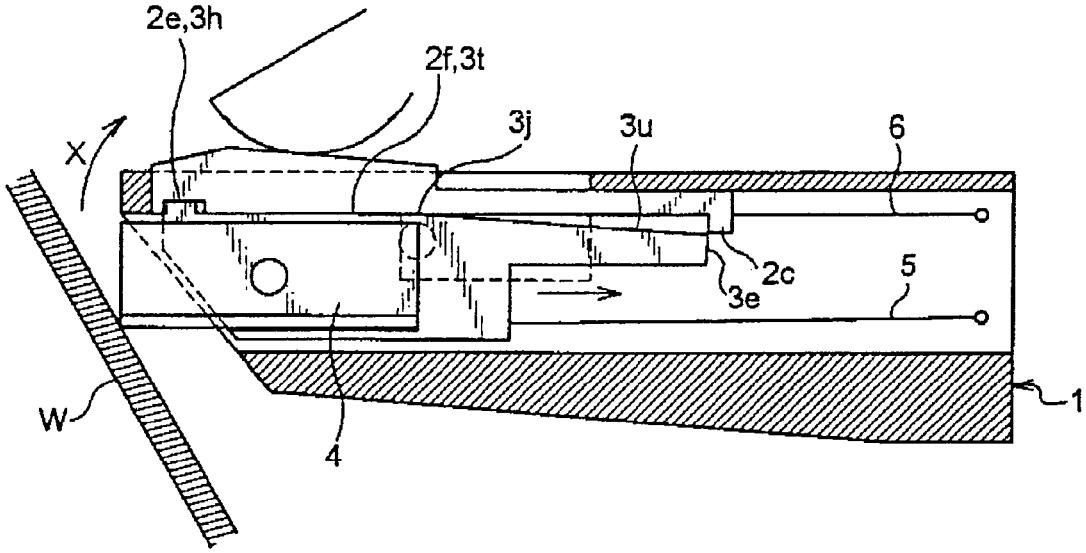
Figures 2, 3, 4:
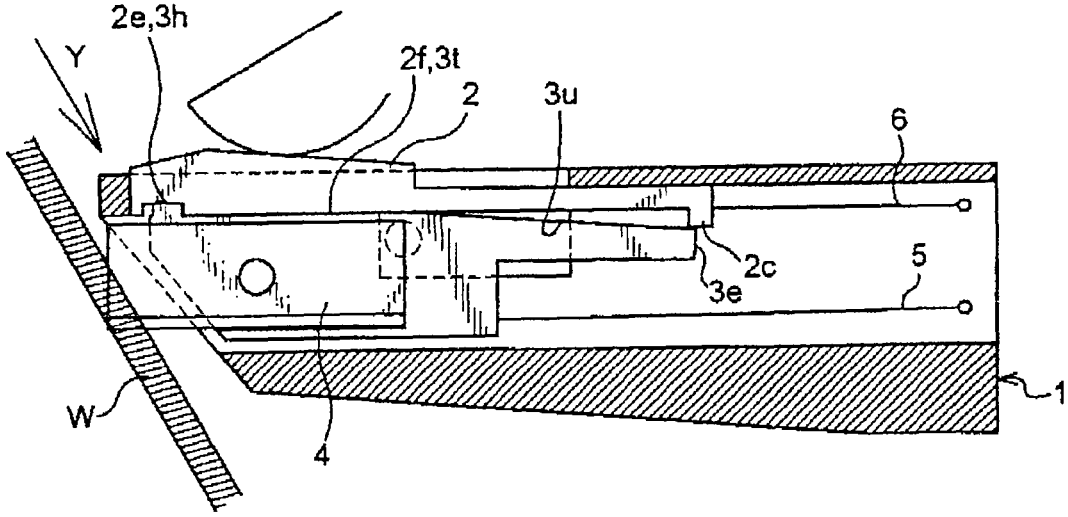
Figures 2, 3, 4, 5:
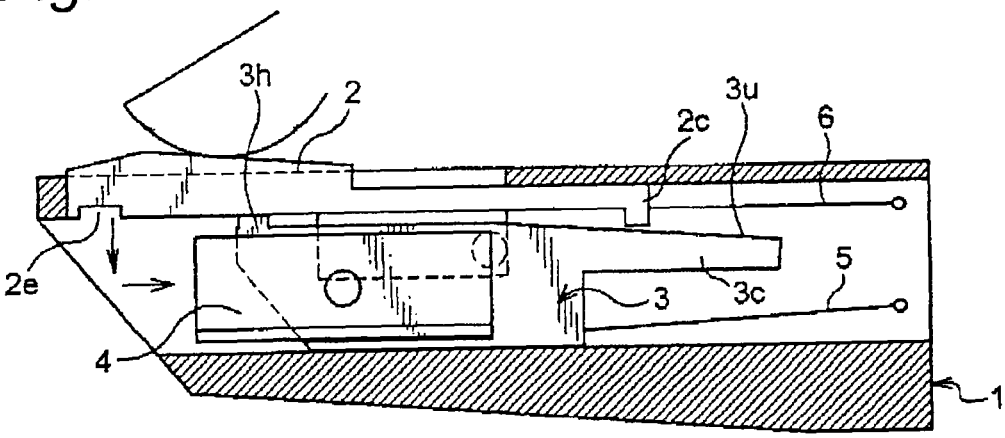
Figures 2, 3, 4, 5, 6:
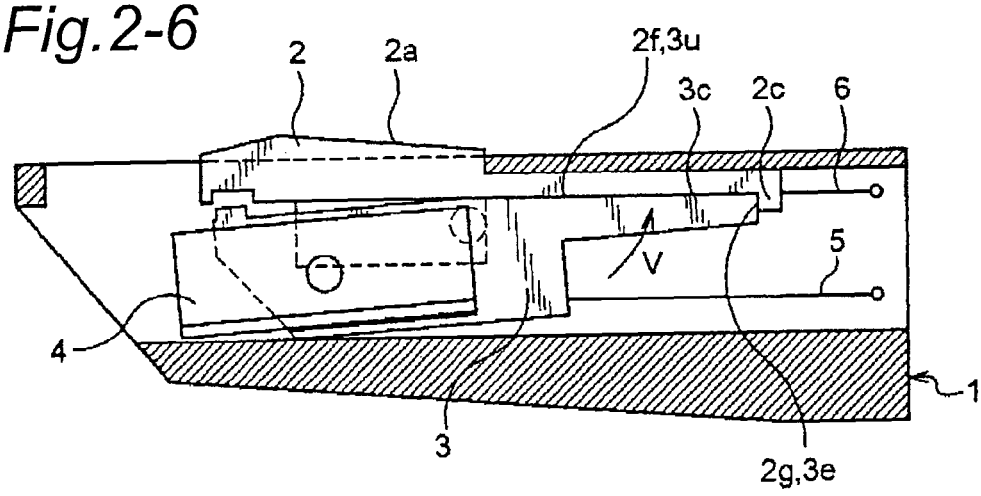
Figures 2, 3, 4, 5, 6, 7:
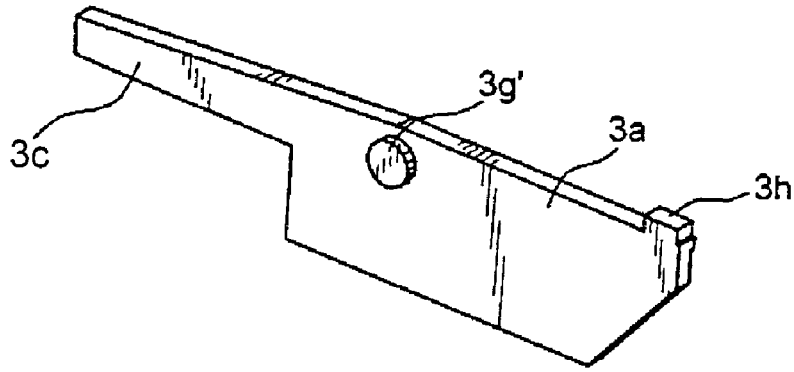
Figures 2, 3, 4, 5, 6, 7, 8:
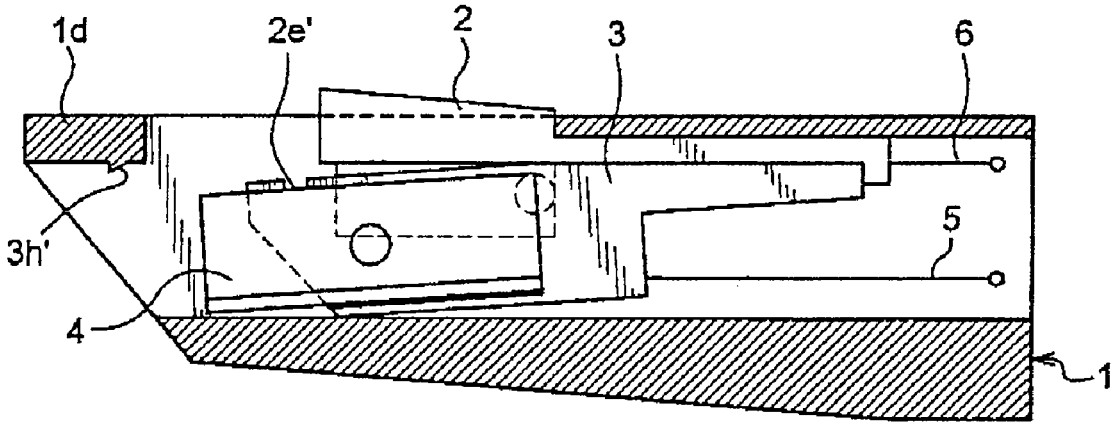
Figure 3:
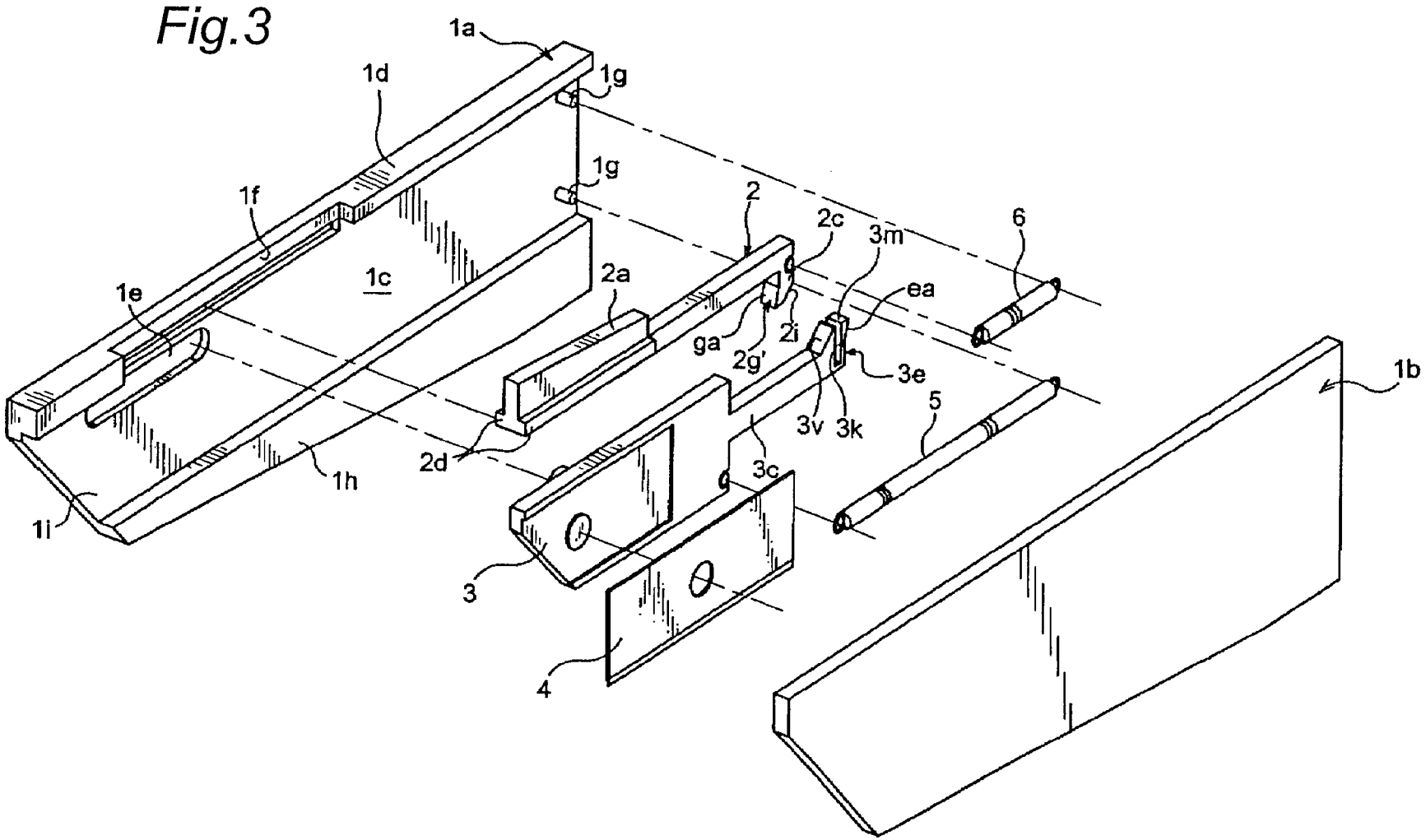
Figures 1, 3:
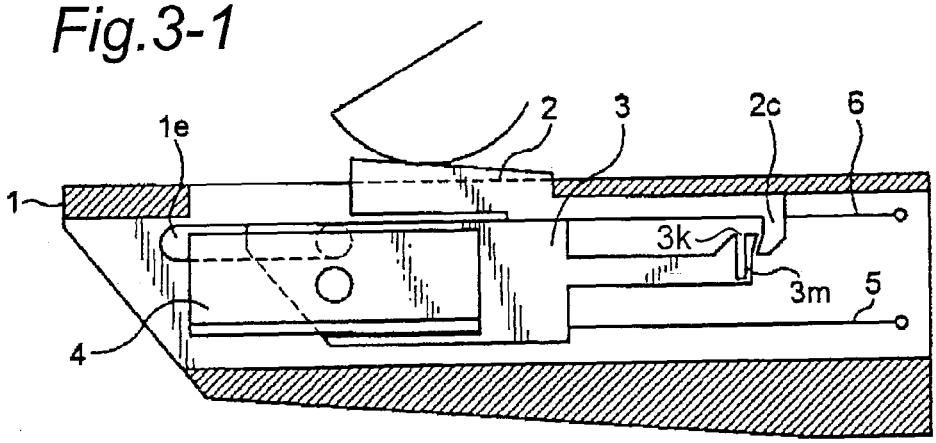
Figures 2, 3:
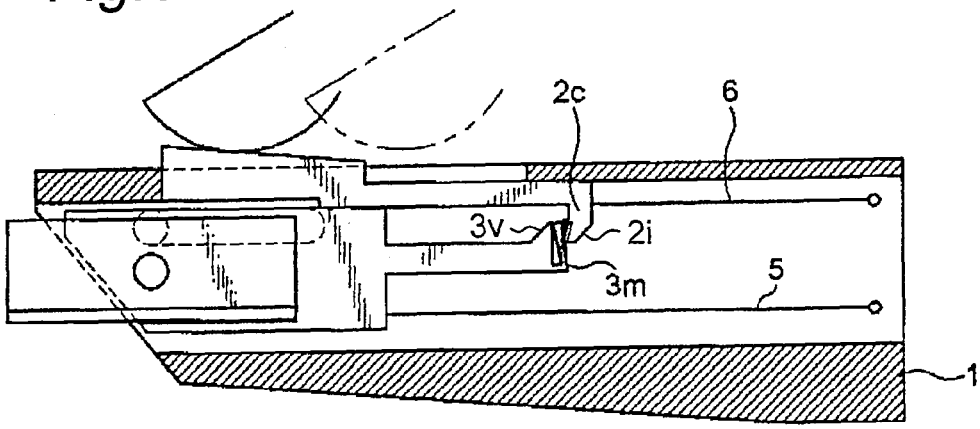
Figure 3:
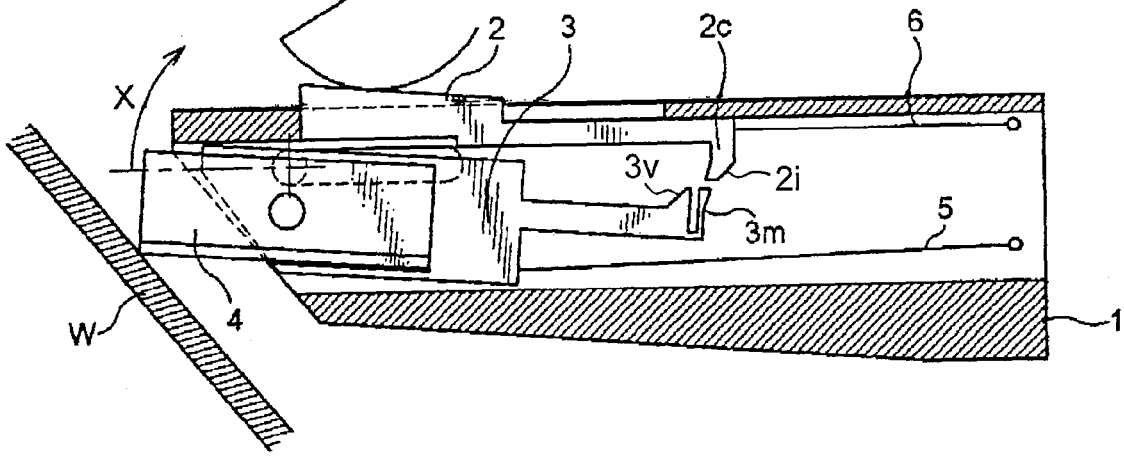
Figures 3, 4:
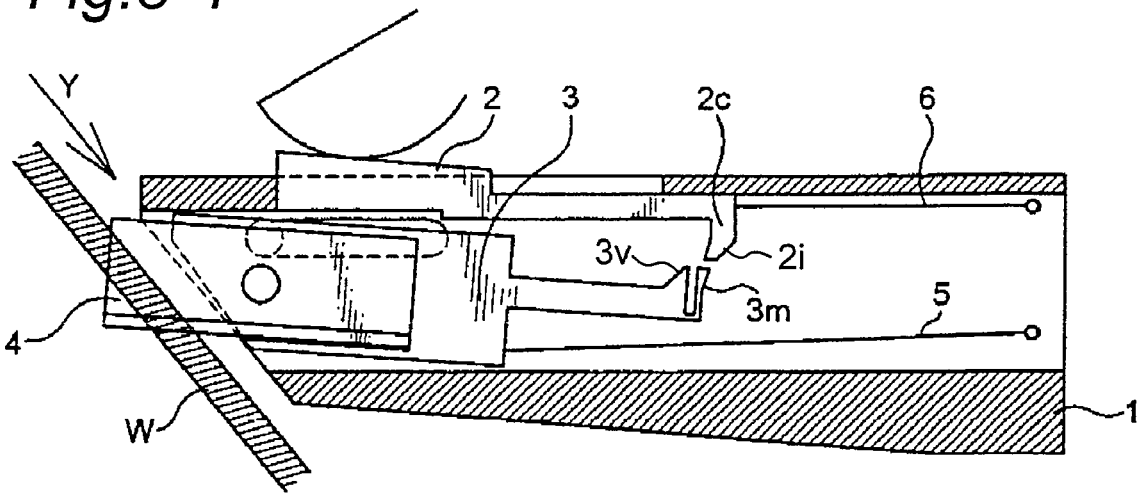
Figures 3, 4, 5:
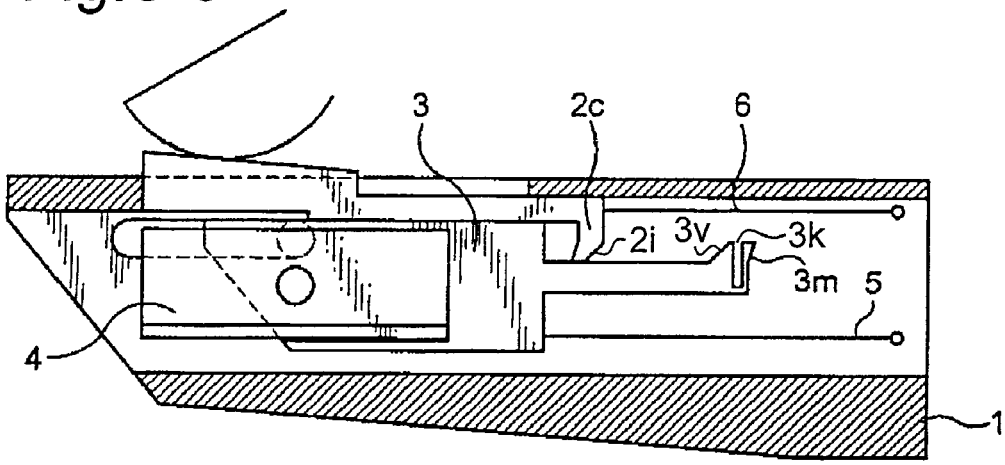
Figures 3, 4, 5, 6:
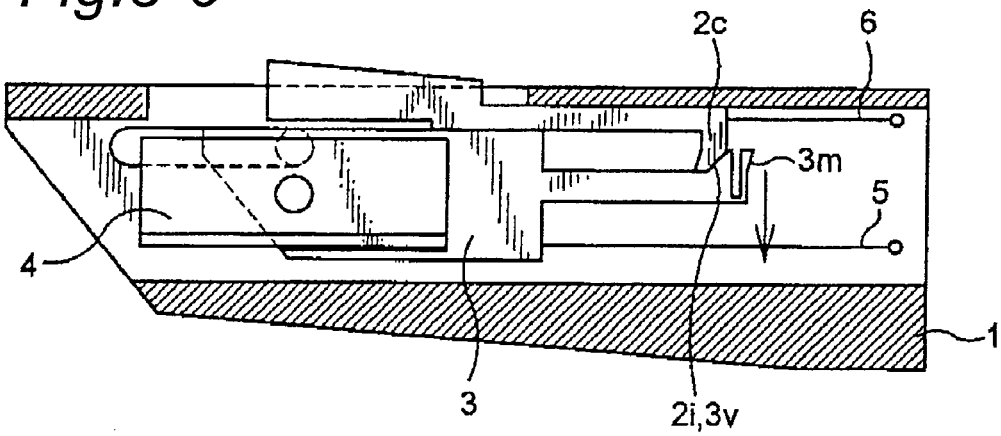
Figure 4:
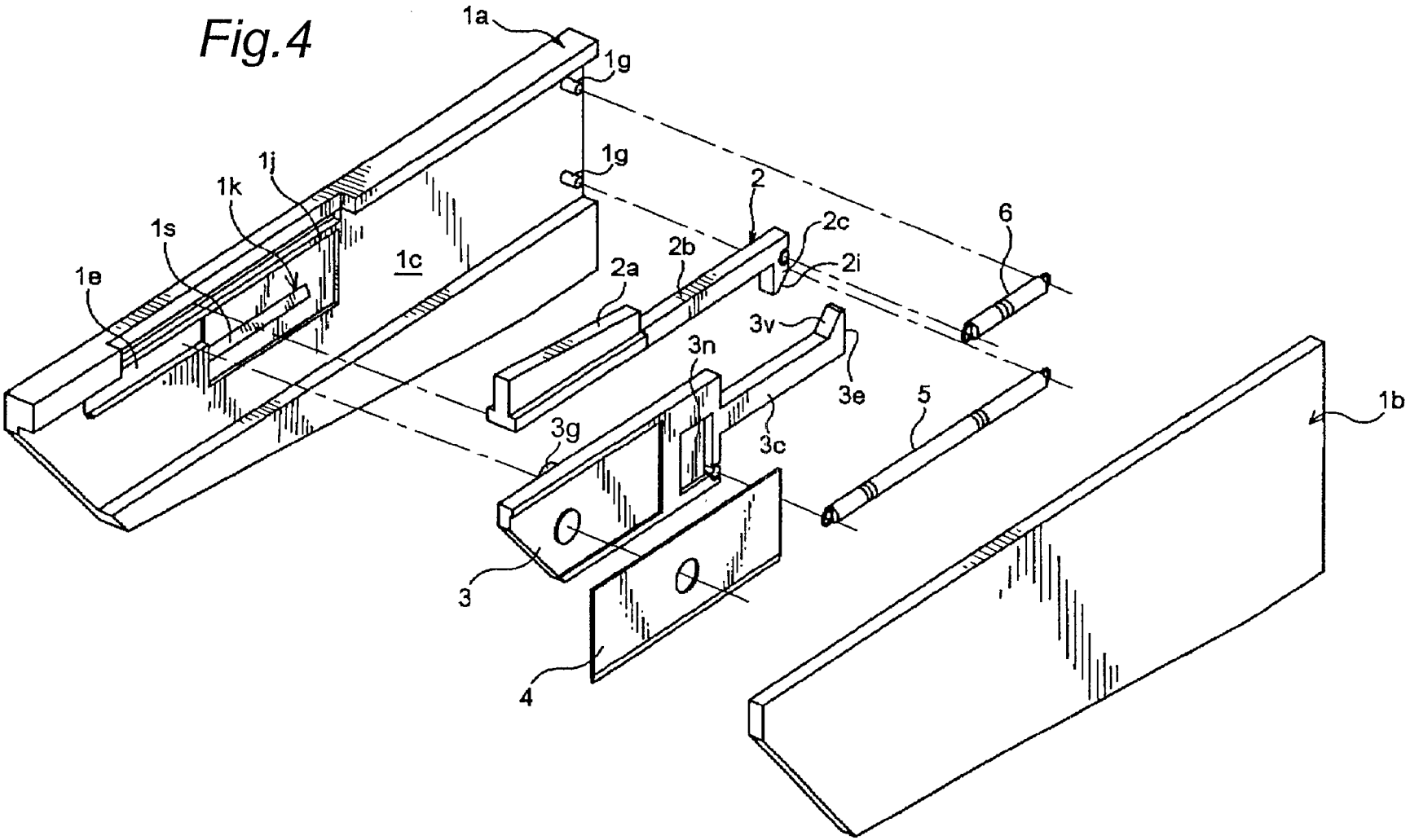
Figures 1, 4:
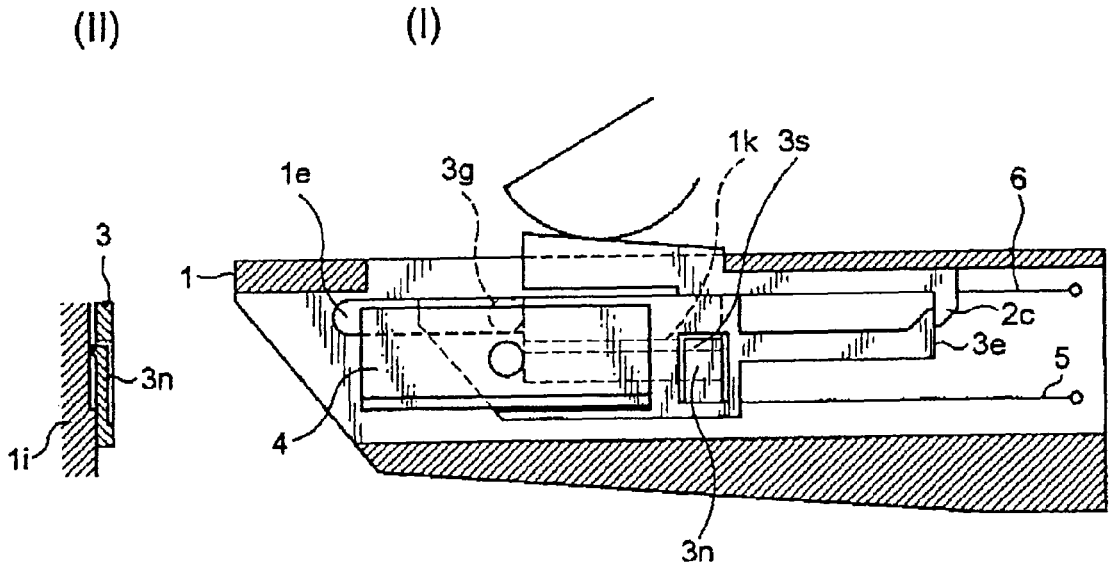
Figures 2, 4:
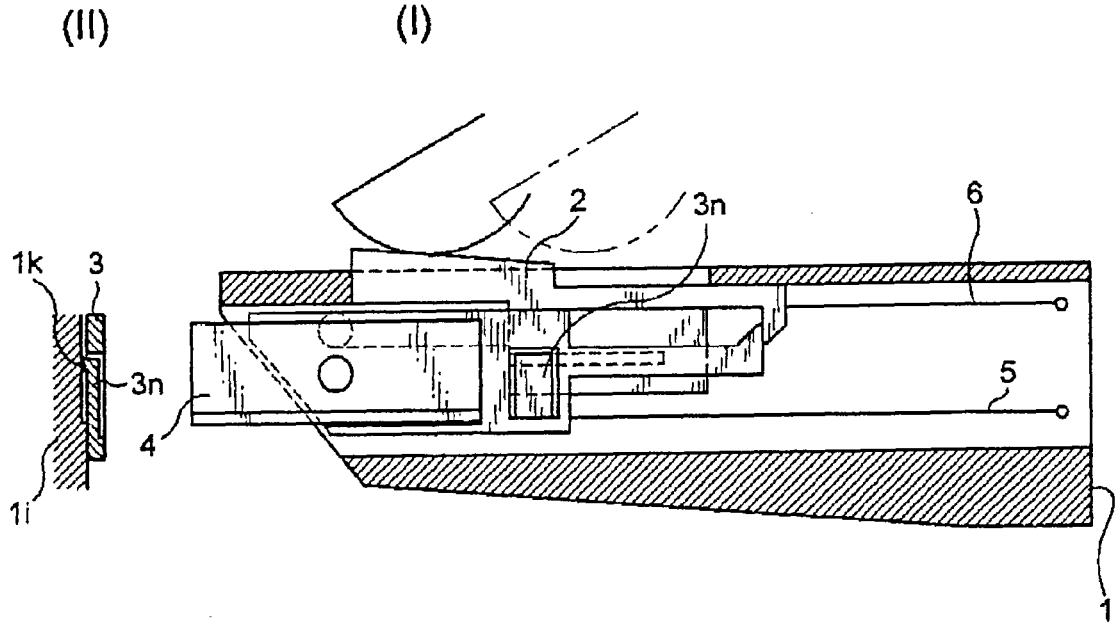
Figures 3, 4:
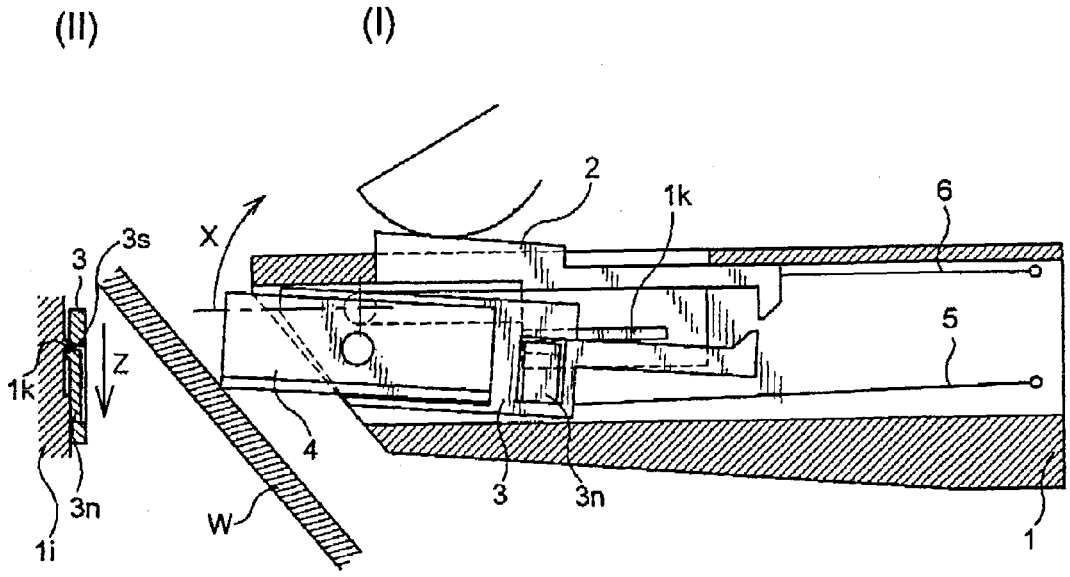
Figure 4:
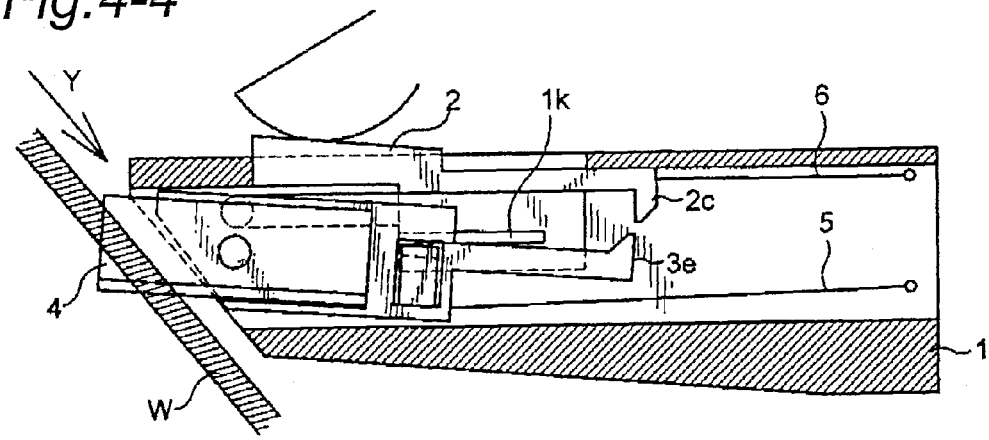
Figures 4, 5:
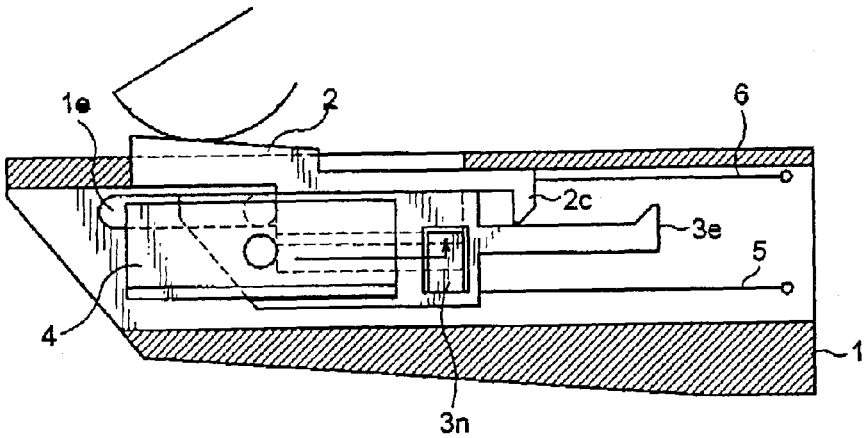
Figures 4, 5, 6:
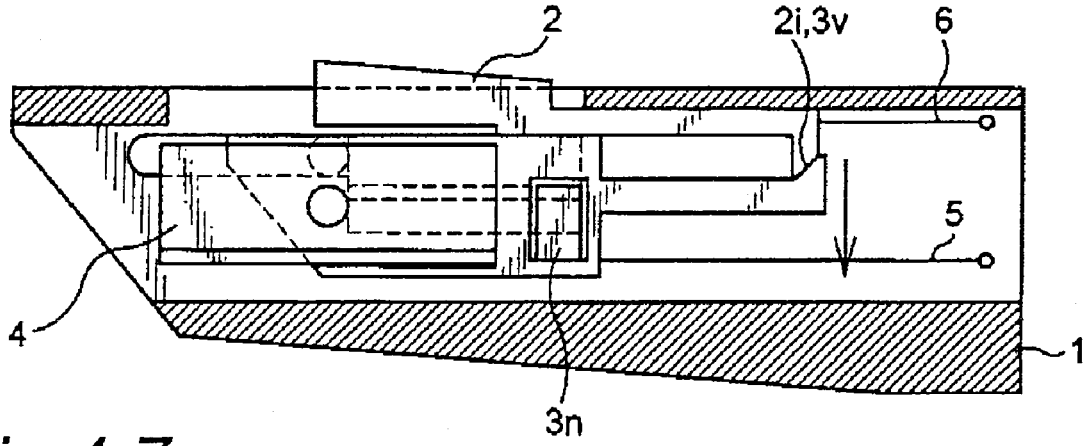
Figures 4, 5, 6, 7:
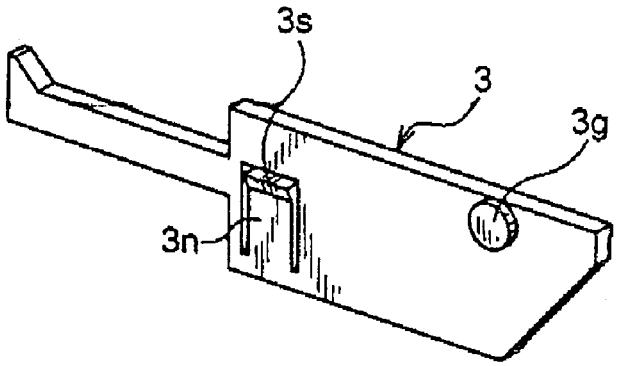
Figure 5:
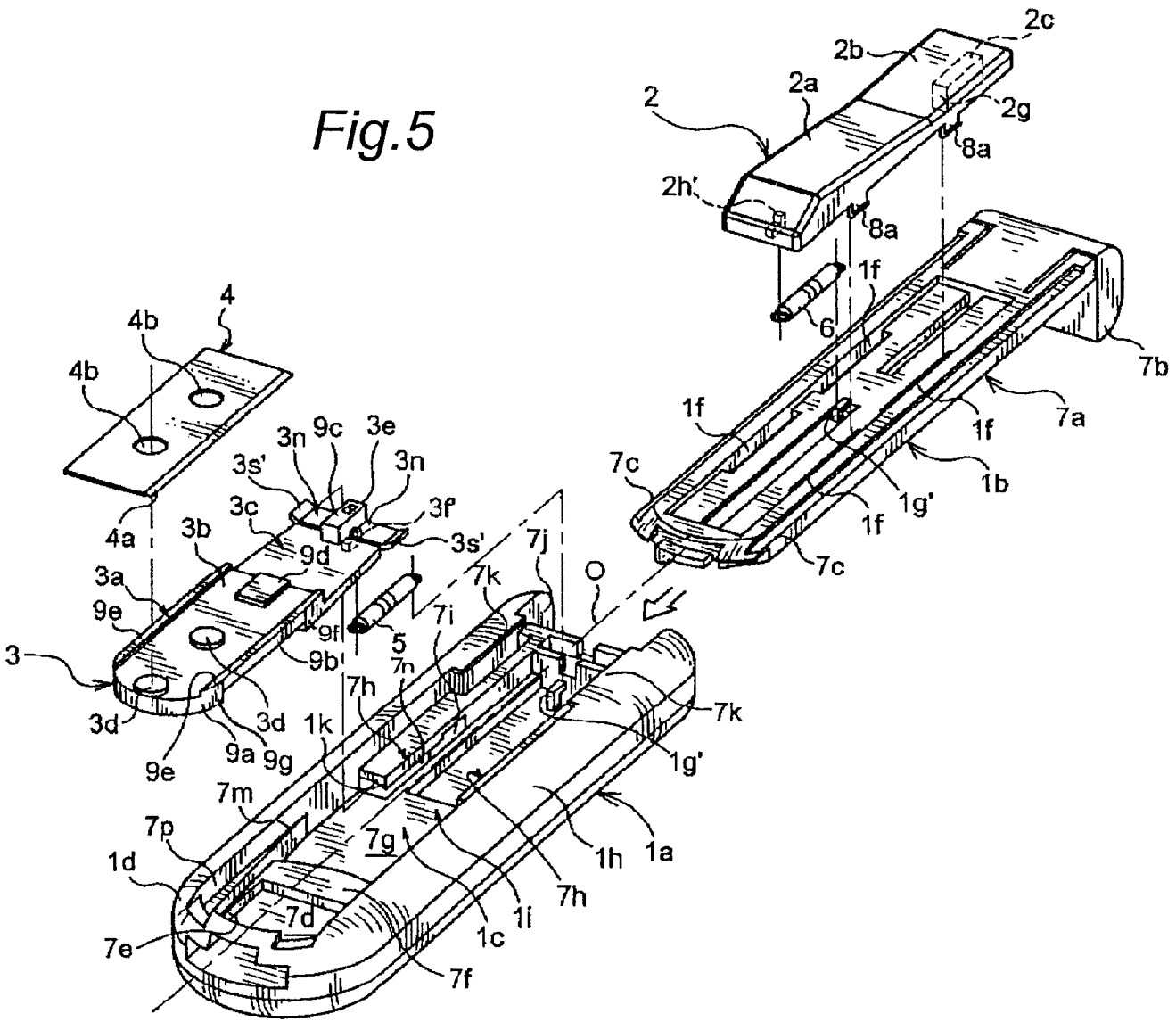
Figures 1, 5:
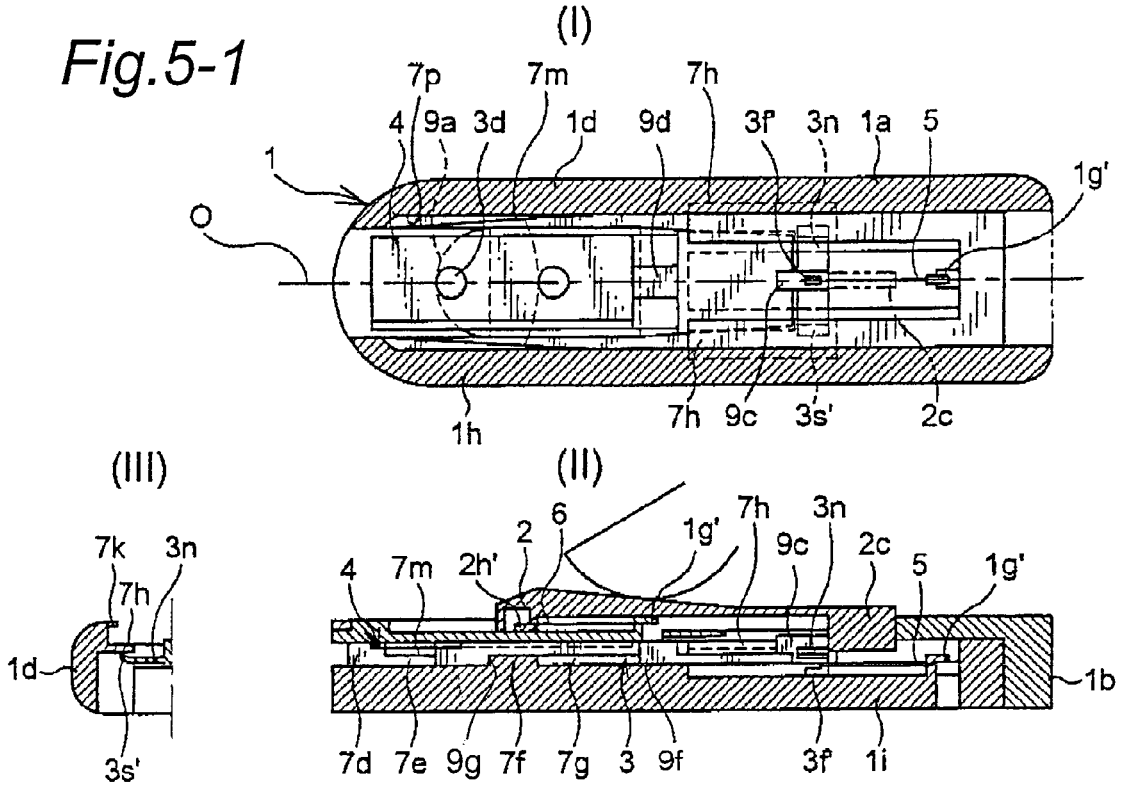
Figures 2, 5:
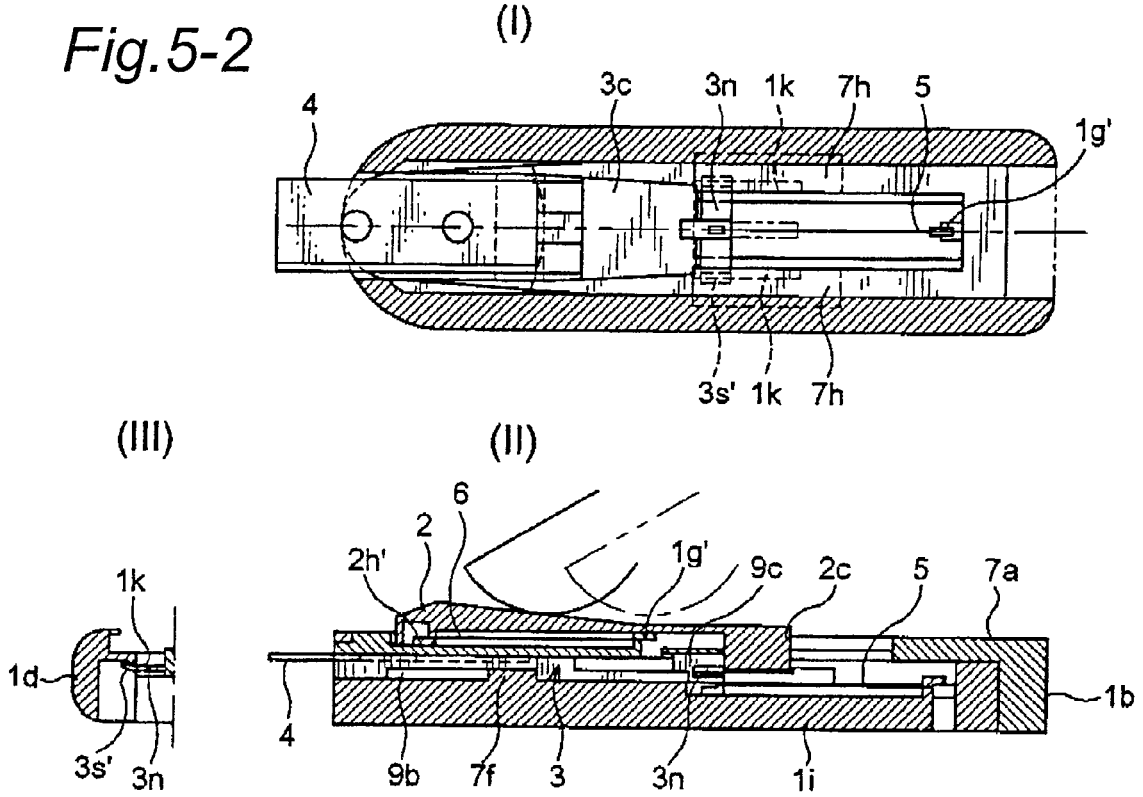
Figures 3, 5:
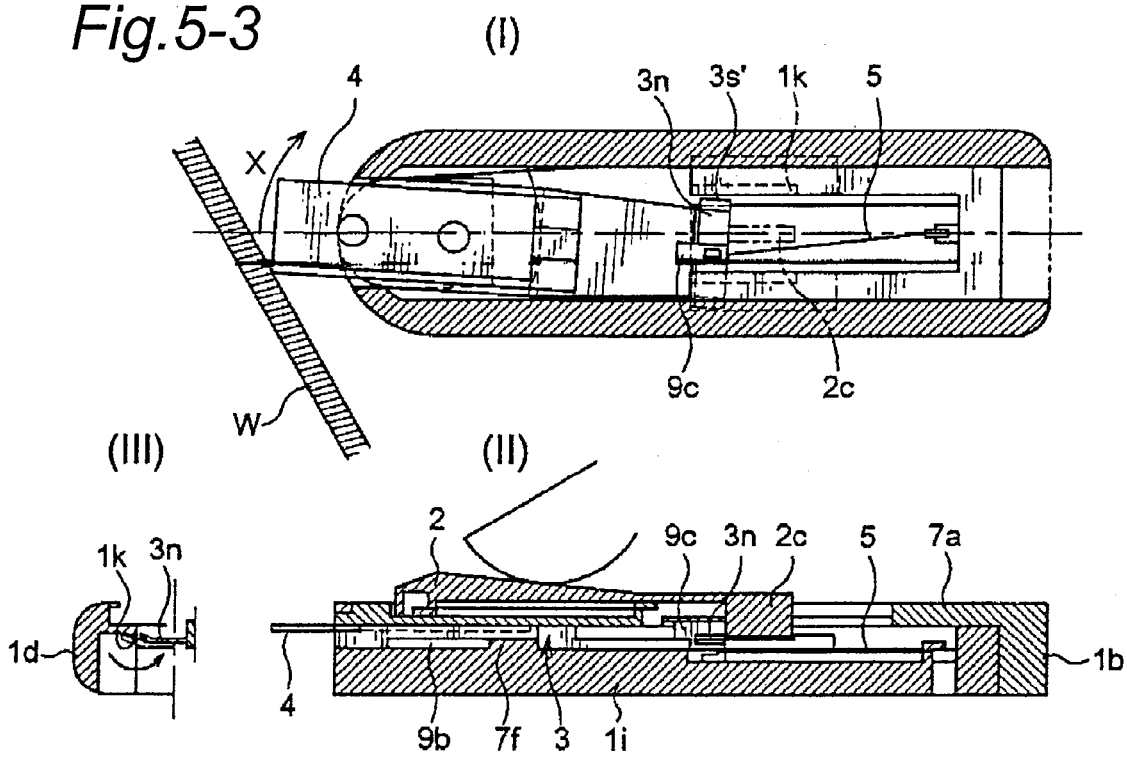
Figures 4, 5:
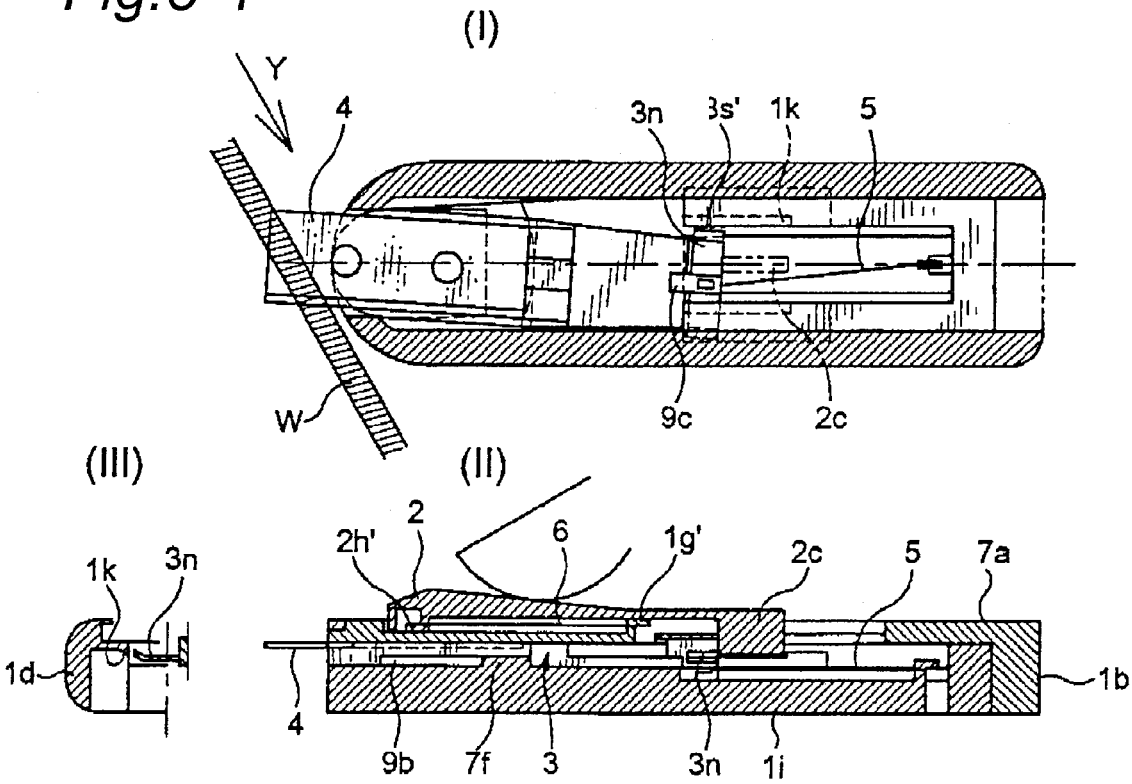
Figure 5:
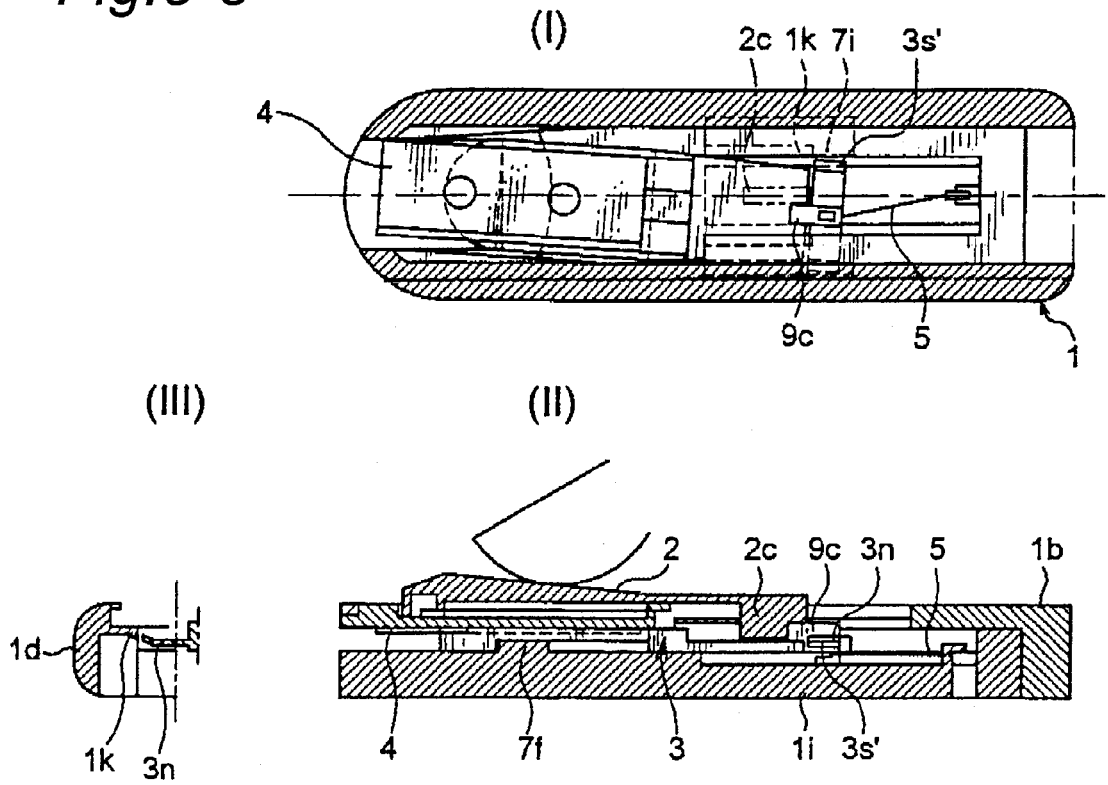
Figures 5, 6:
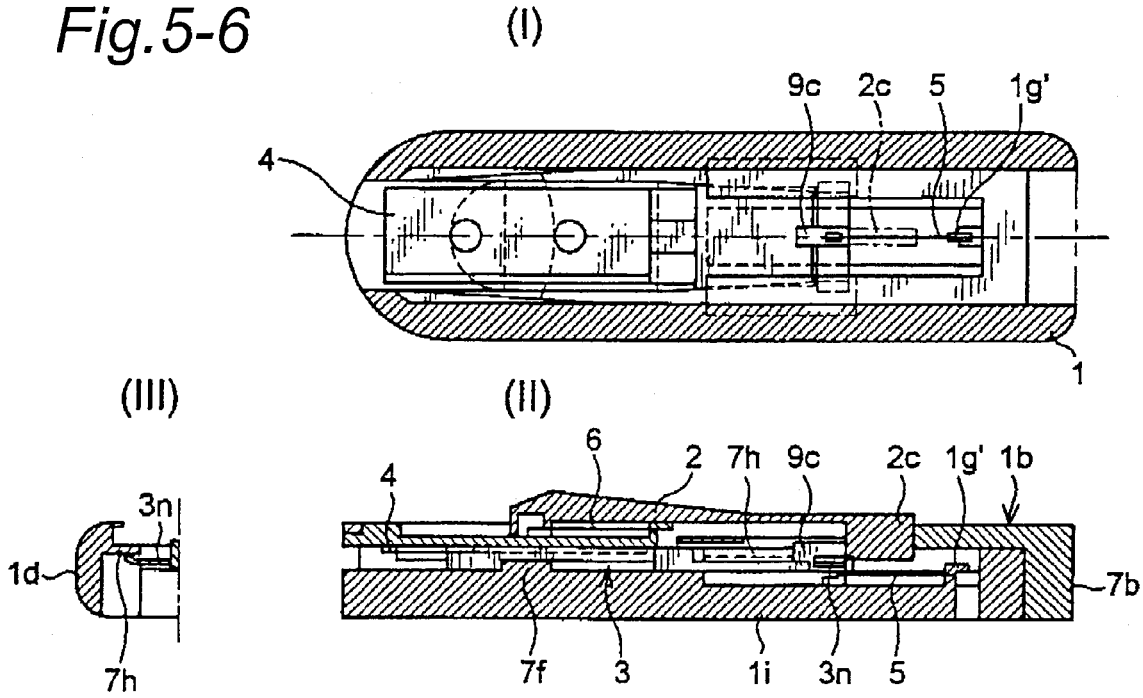

In the third embodiment shown in FIGS. 4 and 4-1 to 4-7, the front end of the housing 1 has an inclined opening so that the cutting edge 4*a* at the lower portion of the blade 4 protrudes sufficiently from the inclined opening. Although the cutter knife according to the third embodiment is designed for a right-handed user, it can also be used by a left-handed user. However, if a left-handed user grips the cutter knife in the third embodiment, he may feel uncomfortable, because the front and back sides of the housing 1 are located in opposite, compared when the right-handed user grips the same. Hence, it is preferable that the cutter knife has a mechanism that is applicable to both right- and left-handed users with the selection of the upper/lower position of the cutting edge of the blade when it is mounted to the blade slide, as well as the mechanism does not cause trouble to the cutting operation. FIG. 5 is an exploded perspective view showing the safety cutter knife according to the fourth embodiment, and FIGS. 5-1 to 5-6 are explanatory views showing the operation of the cutter knife.

As shown in the figures, in this embodiment, a housing body 1*a*, a lid body 1*b*, a blade slide 3, and an actuator slide 2 are all formed substantially symmetrical with respect to the longitudinal center line of the housing, so that the safety cutter knife can be adapted for both right- and left-handed users.

The safety cutter knife basically comprises a housing 1 (1*a*+1*b*), a blade slide 3, an actuator slide 2, a first spring 5, and a second spring 6. The blade slide 3 is accommodated inside the housing 1 so as to be movable in the longitudinal direction between two positions, that is, a retracted position (FIGS. 5-1 and 5-6) and an extended position (FIG. 5-2), and a blade 4 is held at the front end of the blade slide 3. The actuator slide 2 is accommodated inside the housing 1 so as to be movable in the longitudinal direction between two positions, that is, a retracted position and an extended position. The actuator slide 2 moves from the retracted position to the extended position when the actuator slide 2 is accessed by the user from the outside of the housing 1 and pressed by thumb operation. The first spring 5 always energizes the blade slide 3 in the direction toward the retracted position, and the second spring 6 always energizes the actuator slide 2 in the direction toward the retracted position. This basic configuration is the same as that of the first embodiment.

The housing 1 is assembled by pushing the lid body 1*b* into the housing body 1*a* from behind, as clearly shown in FIG. 5. The lid body 1*b* comprises a plate portion 7*a* and a stopper portion 7*b* protruding in an L-shape at the rear of the plate portion 7*a*. The actuator slide 2 slides on the lid body 1*b*. On the other hand, the housing body 1*a* has a space 1*c* for accommodating various members, such as the blade 4, the blade slide 3, and the first and second springs 5 and 6. This accommodation space 1*c* is formed of an upper wall 1*d*, a lower wall 1*h*, and a flat wall 1*i*. The lid body 1*b* of the housing has a brim portion 7*c* on each side in the width direction. When the lid body 1*b* is inserted into the housing body 1*a* from behind, the brim portions 7*c* are positioned under a pair of holding guides 7*k* formed on the housing body 1*a*. The stopper portion 7*b* of the lid body 1*b* is adapted to snugly fit in the fitting portion 7*j* that is formed at the rear end of the housing body 1*a*. At four positions of the lid body 1*b*, four knob-guide-slots 1*f* are formed, in which the four engage pawls 8*a* of the actuator slide 2 are inserted respectively and slide in the back-and-forth direction. At the front portion of the flat wall 1*i*, a raised portion 7*f* is formed to restrict further movement of the blade slide 3. At front side of this raised portion 7*f*, a first concave portion 7*d* is formed, and at the back side of the raised portion 7*f*, a second concave portion 7*g* is formed. The inner faces 7*p* of the upper and lower walls 1*d* and 1*h* are formed in parallel with each other and opposed to each other. At the front portions of the respective inner faces 7*p* and at above the raised portion 7*f* and above the first concave portion 7*d*, tapered faces 7*m* are formed, the distance therebetween being reduced toward the front. On the other hand, the guide side faces 7*e* on both side walls of the first concave portion 7*d* are formed in parallel with each other. At the inner rear portion of the flat wall 1*i*, an engage hook 1*g*' is provided along the longitudinal center line 'O'. This engage hook 1*g*' is used to hold the rear end of the first spring 5.

In the rear half portion of the housing body 1*a*, a pair of eave-shaped guides 7*h* is formed, extending from the upper and lower walls 1*d*, 1*h* toward the longitudinal center line '0'. A constant clearance 7*n* is formed between the eave-shaped guides 7*h* and the flat wall 1*i*. On each face of the eave-shaped guides 7*h* opposed to the flat wall 1*i*, a rib 1*k* is formed extending in the longitudinal direction of the housing 1. The rib 1*k* terminates in halfway to form an opening cutout 7*i* behind the rear end of the rib 1*k* of the eave-shaped guide 7*h*. The rib 1*k* and the opening cutout 7*i* are used to cooperate with the click spring piece 3*n* of the blade slide 3, as described later.

The actuator slide 2 comprises a knob 2*a* that can be operated outside the housing 1 with the user's thumb, and an extension portion 2*b* extending rearward from the knob 2*a*. At the rear portion of the extension portion 2*b*, a second engage portion (a hook 2*c*) protruding toward the lid body 1*b* is provided along the longitudinal center line 'O'. The front face of the hook 2*c* serves as a pushing-engage-face 2*g* that can press the first engage portion (pushed-engage-face) 3*e* of the blade slide 3, as described later. The four engage pawls 8*a* formed at four positions on the actuator slide 2 are inserted into the knob-guide-slots if of the lid body 1*b*, so that the actuator slide 2 can slide in the back-and-forth direction between the retracted position and the extended position with respect to the lid body 1*b*, as described above. The user can access to the knob 2*a* and move the actuator slide 2 with his/her thumb.

The blade slide 3 comprises a blade holding portion 3*a* for holding the blade 4, and an extension portion 3*c*. The extension portion 3*c* is positioned under the knob extension portion 2*b* of the actuator slide 2 and extends rearward from the blade holding portion 3*a* in nearly parallel with the knob extension portion 2*b*. At the rear end of the extension portion 3*c*, there is provided a hook 9*c* which cooperates with the hook 2*c* of the actuator slide 2. At the rear end of this hook 9*c*, there is formed the first engage portion (pushed-engage-face) 3*e*, with which the pushing-engage-face 2*g* of the hook 2*c* can makes contact from behind. A blade accommodating concave portion 3*b* is formed on the front side of the blade holding portion 3*a*. This blade accommodating concave portion 3*b* comprises side walls 9*e* on both sides and a blade holding block 9*d*. In the blade accommodating concave portion 3*b*, a pair of blade holding protrusions 3*d* is formed. The blade 4 having a nearly rectangular shape is accommodated in the blade accommodating concave portion 3*b*, and the blade holding protrusions 3*d* are fitted in the engage holes 4*b* of the blade 4. A semicircular wall 9*a* is formed at the front end of the blade holding portion 3*a*. On the back face side of the blade holding portion 3*a*, a concave portion 9*b* is formed, in which the raised portion 7*f* of the housing 1 is fitted. At the front side of the concave portion 9*b*, a front step portion 9*g* is formed. At the rear side of the concave portion 9*b*, a rear step portion 9*f* is formed. The blade slide 3 can move in the range of the back-and-forth width of the concave portion 9*b*, in other words, between the retracted position and the extended position.

On the back face side of the rear end of the blade slide 3, an engage hook 3*f* is provided, to which the front end of the first spring 5 is hooked. On the other hand, the rear end of the first spring 5 is hooked to the engage hook 1*g*' protruding at the rear portion of the flat wall 1*i* of the housing body 1*a*. Hence, the blade slide 3 is always energized by the first spring 5 in the direction toward the retracted position. The rear end of the second spring 6 is hooked to the engage hook 1*g*' of the lid body 1*b*, and the front end of the spring 6 is hooked to the engage hook 2*h*' formed on the actuator slide 2. With this configuration, the two slides 2 and 3 are always energized by the two springs 5 and 6, so as to be pulled into the housing 1.

At the rear end of the blade slide 3, a pair of upper/lower click spring pieces 3*n* is formed, which cooperate with a pair of associated upper/lower ribs 1*k*. At the end of each click spring pieces 3*n*, a pawl-shaped click protrusion 3*s*' is formed. The pair of ribs 1*k* and the pair of click spring pieces 3*n* form a pair of rotational-position-retaining-mechanisms. When the blade slide 3 is retracted into the housing body 1*a*, the pawl-shaped click protrusion 3*s*' of each click spring pieces 3*n* is positioned under the corresponding eave-shaped guide 7*h*, that is, outside the rib 1*k* (away side from the longitudinal center line 'O').

Next, the operation of the cutter knife configured as described above and the further detailed structure thereof will be described referring to FIGS. 5-1 to 5-6.

FIG. 5-1 is an operation explanatory view showing the initial state of the cutter knife shown in FIG. 5. The actuator slide 2 is retracted to the retracted position by the second spring 6, and the blade slide 3 is also retracted to the retracted position by the first spring 5. Each of the engage pawls 8*a* of the actuator slide 2 is in abutting contact with the retracted position end of the corresponding knob-guide-slots 1*f*. Furthermore, the front step portion 9*g* of the blade slide 3 is in abutting contact with the raised portion 7*f* of the housing body 1*a*. At this time, the pair of pawl-shaped click protrusion 3*s*' is located in the opening cutout 7*i* formed in the eave-shaped guides 7*h*. In the state in FIG. 5-1, when the user operates the knob 2*a* with his/her thumb to push the knob toward the extended position in the longitudinal direction of the housing 1, the two slides 2 and 3 reach their respective extended positions (FIG. 5-2). The pushing-engage-face 2*g* of the hook 2*c* pushes forward the pushed-engage-face 3*e* of the blade slide 3. As a result, the front portion of the blade 4 is exposed outside sufficiently. At this time, each of the engage pawls 8*a* of the actuator slide 2 makes contact with the front end of each of the knob-guide-slots if. During the movement from the retracted position to the extended position, the blade slide 3 is guided by the guide side faces 7*e* on both sides of the first concave portion 7*d*. In other words, the width of the semicircular wall 9*a* at the front end of the blade slide 3 is configured nearly equal to the distance between the guide side faces 7*e*. Furthermore, each of the pawl-shaped click protrusions 3*s*' of the pair of click spring pieces 3*n* moves under the eave-shaped guide 7*h* and outside the rib 1*k* (away side from the longitudinal center line 'O'). When the blade slide 3 is at the extended position, both sides of the semicircular wall 9*a* at the front end of the blade slide 3 are nearly in contact with the tapered faces 7*m* on both sides.

When a work material W is cut, the cutting edge of the blade 4 is pressed against the work material W as shown in FIG. 5-3, and further quickly pressed down as shown in FIG. 5-4. Then, the blade 4 together with the blade slide 3 is rotated slightly upward in the direction X in the figure around an end of the semicircular wall 9*a* of the blade slide 3, which is in contact with a front end of one tapered faces 7*m*, by the reaction force exerted from the work material W against the energizing force of the first spring 5. At this time, both the tapered faces 7*m* allow the rear end of the blade slide 3 to swing sideways.

At this time, the click protrusion 3*s*' of the upper click spring piece climbs over elastically the upper rib 1*k* and moves from upward to downward (Note that another lower rib is provided at opposite side to the upper rib 1*k* with respect to the longitudinal center line 'O': see FIG. 5-2). At this time, the user feels the clicking, and perceives that the blade has been rotated. This rotated attitude or rotational position of the blade slide 3 is kept by the fact that the click protrusion 3*s*' engages the upper rib 1*k* from downward. At this time, the lower click protrusion of the other (lower) click spring piece just moves further downward far from the associated lower rib.

In this operation, the upper click spring piece is located at following side of the rotation, and the lower click spring piece is located at the leading side of the operation.

By this rotation, the pushed-engage-face 3*e* of the blade slide 3 is disengaged from the hook 2*c*, as shown in FIGS. 5-3 and 5-4. In other words, the engagement between the first and second engage portions 3*e* and 2*c* is released, and the blade slide 3 would be able to return to the retracted position by virtue of the tension force of the first spring 5. However, the blade slide 3 holding the blade 4 does not return automatically to the retracted position under the friction force generated by the work material W to the blade 4, because the blade 4 has cut into the work material W, and the cutter knife is being wholly pulled down along the work material W in the direction Y. When the cutting is completed (FIG. 5-5), the blade 4 is released from the work material W. At the moment when the blade 4 is released, the blade slide 3 holding the blade 4 returns automatically to the initial position (retracted position). This automatic return occurs even if the thumb of the user makes contact with the knob 2*a* as shown in FIG. 5-5 (regardless of the position of the knob 2*a*). Thus, when the cutting operation is completed, the blade 4 is accommodated into the housing, and danger of cutting user itself with the blade owing to the momentum of the cutting operation can be prevented.

When the blade slide 3 returns to the retracted position, the click protrusion 3*s*', having climbed over the upper rib 1*k* to downward, moves under side of the upper rib 1*k*. Hence, the blade slide 3 returns, with its rotated attitude being kept. When the blade slide 3 reaches the retracted position, that is, the final position, the click protrusion 3*s*' is positioned in the opening cutout 7*i*, thereby being released from the rib 1*k*. However, since the hook 9*c* of the blade slide 3 makes contact with the side face of the hook 2*c* (FIG. 5-5), the rotated attitude is kept even at the retracted position. When the user releases his/her thumb from the knob 2*a* of the actuator slide 2 at the final stage, the actuator slide 2 returns to the retracted position by virtue of the tension force of the second spring 6, and the hook 9*c* is released from the hook 2*c*. This allows the blade slide 3 to return to the non-rotated state shown in FIG. 5-1 (see FIG. 5-6). When the blade slide 3 returns to the non-rotated state, the pushed-engage-face (first engage portion) 3*e* engages the pushing-engage-face 2*g* (second engage portion) of the hook 2*c*.

The above explanation is directed to a case, where the direction of the blade 4 on the blade slide 3 is selected for a right-handed user. If a left-handed user uses this cutter knife, the blade 4 is to be set upside down on the blade slide 3, such that the cutting edge 4*a* is directed upward in FIG. 5-1. In the above explanation with FIGS. 5 and 5-1 to 5-6, the upper click spring piece 3*n* (at the following side of the rotation) and the upper rib 1*k* are in operation when the blade is rotated. However, when the blade is set for a left-handed user, the lower click spring piece and the lower rib will be in operative when the blade is rotated.

When the cutter knife is gripped by the left-handed user, the lower click spring piece shown in the figures, in turn, would be located at the following side of the rotation in such the application.

Although the present invention has been fully described in connection with the preferred embodiment thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A safety cutter knife comprising:

a housing;

a blade slide accommodated inside the housing so as to be movable in a longitudinal direction of the housing between a retracted position and an extended position, the blade slide holding a blade at a front end thereof;

an actuator slide accommodated inside the housing so as to be movable in the longitudinal direction of the housing between a retracted position and an extended position, and movable from the retracted position to the extended position when the actuator slide is accessed by a user from outside of the housing and pushed by the user;

a first spring that always energizes the blade slide toward the retracted position;

a second spring that always energizes the actuator slide toward the retracted position;

wherein the blade slide is provided with a first engage portion, wherein the actuator slide is provided with a second engage portion, and wherein the second engage portion is in an abutting relationship with the first engage portion to move the blade slide from the retracted position to the extended position when the actuator slide is pushed from the retracted position to the extended position by the user, a blade rotation mechanism, wherein when a cutting edge of the blade extending from the housing is pressed into a work material while the blade slide and the actuator slide are located at the extended position, the blade rotates together with the blade slide in a nearly perpendicular direction to the longitudinal direction of the housing by virtue of a reaction force from the work material, such that the first engage portion and the second engage portion are no longer in the abutting relationship and such that when the blade is no longer in contact with the work material, the blade slide returns automatically from the extended position to the retracted position by virtue of an energizing force of the first spring; and a rotational-position-retaining-mechanism, which keeps a rotational position of the blade slide, from a time the blade slide is rotated up at the extended position in a cutting operation, to a time the blade slide returns to just before the retracted position after the cutting operation is completed.

2. The safety cutter knife of claim 1, wherein the rotational-position-retaining-mechanism comprises a rib formed on an inner face of the housing opposed to the blade slide extending in the longitudinal direction of the housing, and a click spring piece formed on the blade slide opposed to the rib so as to cooperate with the rib, wherein when the blade slide is located at the retracted position, the click spring piece does not touch the rib, wherein when the blade slide moves from a position slightly ahead of the retracted position to the extended position, a click protrusion of the click spring piece passes along an upper side of the rib, wherein when the blade slide is rotated at the extended position by virtue of the reaction force from the work material, the click spring piece is deflected elastically, and the click protrusion thereof climbs over the rib and moves from the upper side to a lower side of the rib, and wherein when the blade slide moves from the extended position to just before the retracted position, the click protrusion passes the lower side of the rib, such that the rotational position of the blade slide is kept.

* * * * *